US007004834B2

(12) United States Patent
Walker et al.

(10) Patent No.: US 7,004,834 B2
(45) Date of Patent: Feb. 28, 2006

(54) SYSTEM AND METHOD FOR FACILITATING PLAY OF A GAME WITH USER-SELECTED ELEMENTS

(75) Inventors: Jay S. Walker, Ridgefield, CT (US); James A. Jorasch, Stamford, CT (US); Daniel E. Tedesco, Huntington, CT (US); Stephen C. Tulley, Fairfield, CT (US); John M. Packes, Jr., Hawthorne, NY (US); Russell Pratt Sammon, San Francisco, CA (US); Geoffrey M. Gelman, Stamford, CT (US)

(73) Assignee: Walker Digital, LLC, Stamford, CT (US)

( * ) Notice: Subject to any disclaimer, the term of this patent is extended or adjusted under 35 U.S.C. 154(b) by 40 days.

(21) Appl. No.: 10/374,023

(22) Filed: Feb. 25, 2003

(65) Prior Publication Data

US 2003/0144052 A1 Jul. 31, 2003

Related U.S. Application Data

(63) Continuation-in-part of application No. 09/722,761, filed on Nov. 27, 2000, now Pat. No. 6,561,902, which is a continuation of application No. 09/000, 628, filed on Dec. 30, 1997, now Pat. No. 6,174,235.

(51) Int. Cl.
*A63F 9/24* (2006.01)

(52) U.S. Cl. ..... 463/16; 463/25; 273/139

(58) Field of Classification Search ..... 463/1, 463/9–13, 16–20, 25, 29–30, 40–42; 273/139, 273/269, 236–237, 292–293, 153 R, 429–431; 700/91–93; 283/49, 51, 901, 903
See application file for complete search history.

(56) References Cited

U.S. PATENT DOCUMENTS

| | | | | |
|---|---|---|---|---|
| 3,533,629 | A | 10/1970 | Raven | 273/138 |
| 3,770,269 | A | 11/1973 | Elder | 273/1 E |
| 4,508,345 | A | 4/1985 | Okada | 273/143 R |
| 4,560,161 | A | 12/1985 | Hamano | 273/85 CP |
| 4,624,462 | A | 11/1986 | Itkis | 273/237 |
| 4,648,600 | A | 3/1987 | Olliges | 273/138 A |
| 4,684,128 | A | 8/1987 | Verstraeten | 273/1 GC |

(Continued)

FOREIGN PATENT DOCUMENTS

| | | |
|---|---|---|
| EP | 1 274 053 A2 | 1/2003 |
| WO | WO 97/27569 | 7/1997 |

OTHER PUBLICATIONS

Brochure: "Doors to Riches", Shuffle Master Gaming, undated.

(Continued)

*Primary Examiner*—Mark Sager
(74) *Attorney, Agent, or Firm*—Michael D. Downs

(57) ABSTRACT

Systems and methods are provided for facilitating play of a game with user-selected elements. According to one or more embodiments of the present invention, a set of all possible elements of a game is determined. Each of the elements of the set is associated with at least one of a plurality of locations. A representation of the plurality of locations is displayed to a player, defining a set of selectable locations. At least one selection signal is received, with each selection signal indicating a selectable location from the set of selectable locations, indicating at least one selected element. An outcome is determined based on the at least one selected element.

20 Claims, 13 Drawing Sheets

U.S. PATENT DOCUMENTS

| | | | | |
|---|---|---|---|---|
| 4,695,053 | A | 9/1987 | Vazquez, Jr. et al. | 273/143 R |
| 4,756,531 | A | 7/1988 | DiRe et al. | 273/138 A |
| 4,836,546 | A | 6/1989 | DiRe et al. | 273/138 A |
| 5,118,109 | A | 6/1992 | Gumina | 273/139 |
| 5,178,395 | A | 1/1993 | Lovell | 273/238 |
| 5,192,076 | A | 3/1993 | Komori | 273/138 A |
| 5,351,970 | A | 10/1994 | Fioretti | 273/439 |
| 5,393,057 | A | 2/1995 | Marnell, II | 273/85 CP |
| 5,411,271 | A | 5/1995 | Mirando | 273/434 |
| 5,630,586 | A | 5/1997 | Lowden | 273/138.2 |
| 5,631,947 | A | 5/1997 | Wittstein et al. | 379/59 |
| 5,639,088 | A | 6/1997 | Schneider et al. | 273/138.2 |
| 5,667,438 | A * | 9/1997 | Rehm | 463/9 |
| 6,102,798 | A | 8/2000 | Bennett | 463/16 |
| 6,174,235 | B1 | 1/2001 | Walker et al. | 463/25 |
| 6,309,300 | B1 | 10/2001 | Glavich | 463/26 |
| 6,506,118 | B1 | 1/2003 | Baerlocher et al. | 463/25 |
| 6,561,902 | B1 * | 5/2003 | Walker et al. | 463/25 |

OTHER PUBLICATIONS

"The Washington Gambling Commission is studying a request from a Nevada slot machine company to move "video punchboards" into bars and lounges across the state", May 13, 1985, Distribution: Arizona-Nevada, Section: Regional News.

Ritter, Bill, "The Bottom Line", Los Angeles Times, May 28, 1985, Section: Business, Part 4, p. 2B, Col. 3, Financial Desk.

* cited by examiner

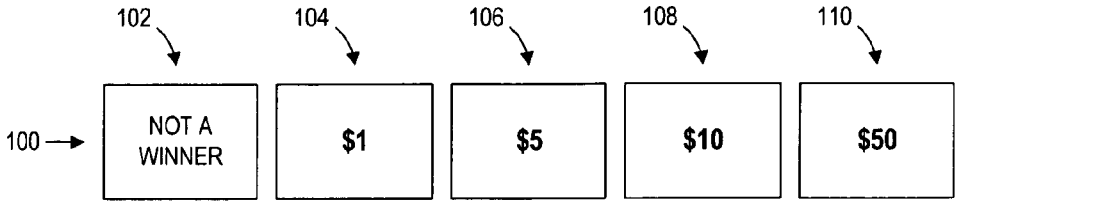

160

| ELEMENT | OCCURENCES |
|---|---|
| $50 | 1 |
| $10 | 2 |
| $5 | 3 |
| $1 | 5 |
| NOT A WINNER | 25 |

| 170 | 180 | 190 | 200 |
|---|---|---|---|
| $50 | 0.29 | 0.01 | NOT A WINNER |
| $10 | 0.67 | 0.02 | $10 |
| $10 | 0.02 | 0.12 | NOT A WINNER |
| $5 | 0.93 | 0.13 | NOT A WINNER |
| $5 | 0.33 | 0.14 | NOT A WINNER |
| $5 | 0.92 | 0.16 | NOT A WINNER |
| $1 | 0.62 | 0.17 | NOT A WINNER |
| $1 | 0.76 | 0.18 | NOT A WINNER |
| $1 | 0.93 | 0.19 | NOT A WINNER |
| $1 | 0.31 | 0.21 | NOT A WINNER |
| $1 | 0.26 | 0.21 | NOT A WINNER |
| NOT A WINNER | 0.59 | 0.23 | NOT A WINNER |
| NOT A WINNER | 0.69 | 0.26 | $1 |
| NOT A WINNER | 0.17 | 0.29 | $50 |
| NOT A WINNER | 0.90 | 0.31 | $1 |
| NOT A WINNER | 0.83 | 0.33 | $5 |
| NOT A WINNER | 0.19 | 0.33 | NOT A WINNER |
| NOT A WINNER | 0.51 | 0.48 | NOT A WINNER |
| NOT A WINNER | 0.01 | 0.49 | NOT A WINNER |
| NOT A WINNER | 0.93 | 0.51 | NOT A WINNER |
| NOT A WINNER | 0.16 | 0.59 | NOT A WINNER |
| NOT A WINNER | 0.49 | 0.62 | $1 |
| NOT A WINNER | 0.18 | 0.67 | $10 |
| NOT A WINNER | 0.98 | 0.69 | NOT A WINNER |
| NOT A WINNER | 0.21 | 0.71 | NOT A WINNER |
| NOT A WINNER | 0.33 | 0.73 | NOT A WINNER |
| NOT A WINNER | 0.23 | 0.76 | $1 |
| NOT A WINNER | 0.12 | 0.82 | NOT A WINNER |
| NOT A WINNER | 0.14 | 0.83 | NOT A WINNER |
| NOT A WINNER | 0.13 | 0.90 | NOT A WINNER |
| NOT A WINNER | 0.82 | 0.92 | $5 |
| NOT A WINNER | 0.71 | 0.93 | $1 |
| NOT A WINNER | 0.48 | 0.93 | NOT A WINNER |
| NOT A WINNER | 0.99 | 0.93 | $5 |
| NOT A WINNER | 0.21 | 0.98 | NOT A WINNER |
| NOT A WINNER | 0.73 | 0.99 | NOT A WINNER |

FIG. 7

210

| | | | | | |
|---|---|---|---|---|---|
| 1 | 7 | 13 | 19 | 25 | 31 |
| 2 | 8 | 14 | 20 | 26 | 32 |
| 3 | 9 | 15 | 21 | 27 | 33 |
| 4 | 10 | 16 | 22 | 28 | 34 |
| 5 | 11 | 17 | 23 | 29 | 35 |
| 6 | 12 | 18 | 24 | 30 | 36 |

220

| | | | | | |
|---|---|---|---|---|---|
| NOT A WINNER | NOT A WINNER | $1 | NOT A WINNER | NOT A WINNER | $5 |
| $10 | NOT A WINNER | $50 | NOT A WINNER | NOT A WINNER | $1 |
| NOT A WINNER | NOT A WINNER | $1 | NOT A WINNER | $1 | NOT A WINNER |
| NOT A WINNER | NOT A WINNER | $5 | $1 | NOT A WINNER | $5 |
| NOT A WINNER | NOT A WINNER | NOT A WINNER | $10 | NOT A WINNER | NOT A WINNER |
| NOT A WINNER | NOT A WINNER | NOT A WINNER | NOT A WINNER | NOT A WINNER | NOT A WINNER |

FIG. 8

1300

A METHOD COMPRISING:

DETERMINING A SET OF ELEMENTS, THE SET INCLUDING ALL POSSIBLE ELEMENTS OF A GAME;

DISPLAYING A REPRESENTATION OF EACH ELEMENT OF THE SET OF ELEMENTS;

AFTER SAID DISPLAYING, ASSOCIATING EACH OF THE ELEMENTS OF THE SET WITH AT LEAST ONE OF A PLURALITY OF LOCATIONS;

AFTER DISPLAYING THE REPRESENTATION OF EACH ELEMENT OF THE SET OF ELEMENTS, DISPLAYING A REPRESENTATION OF A PLURALITY OF LOCATIONS TO A PLAYER, THEREBY DEFINING A SET OF SELECTABLE LOCATIONS;

RECEIVING AT LEAST ONE SELECTION SIGNAL, EACH SELECTION SIGNAL INDICATING A SELECTABLE LOCATION FROM THE SET OF SELECTABLE LOCATIONS, THE AT LEAST ONE SELECTION SIGNAL THEREBY INDICATING AT LEAST ONE SELECTED ELEMENT; AND

DETERMINING AN OUTCOME BASED ON THE AT LEAST ONE SELECTED ELEMENT.

FIG. 13

SYSTEM AND METHOD FOR FACILITATING PLAY OF A GAME WITH USER-SELECTED ELEMENTS

The present application is a continuation-in-part of U.S. patent application Ser. No. 09/722,761, entitled "Method and Apparatus for Directing a Game with User-Selected Elements", filed on Nov. 27, 2000, now U.S. Pat. No. 6,561,901 B1; which is a continuation of U.S. patent application Ser. No. 09/000,628, entitled "Method and Apparatus for Directing a Game with User-Selected Elements", filed on Dec. 30, 1997, now U.S. Pat. No. 6,174,235 B1.The content of each of the above applications is incorporated by reference herein.

FIELD OF THE INVENTION

The present invention relates to gaming devices.

BACKGROUND OF THE INVENTION

Many gamblers believe that when they are feeling "lucky" they are sure to win. In casino games which allow players to add their personal input into the games, players often believe that their "lucky" feelings are transferred to the game and that they can therefore somehow "control" the outcome of the game. When players feel they can control the outcome of a game, they typically will continue to play that game, possibly for prolonged periods of time.

In a typical electronically-controlled slot machine, the player simply pushes a starter button or pulls a handle, and the machine in response randomly generates a sequence of symbols, thereby indicating an outcome for the game. Similarly, in a typical electronically-controlled video poker machine, the player simply pushes a button to have a hand dealt to him, and pushes a button to indicate which cards he would like to hold. The machine responds by randomly generating cards to replace those that are not held. In each case, the player does not provide any input or selection to influence what is randomly generated and provided. Thus, the player may not believe that he truly participates in or has any influence over the outcome of the game.

BRIEF DESCRIPTION OF THE DRAWINGS

The accompanying drawings, which are incorporated in and constitute a part of this specification, illustrate some embodiments of the invention, and together with the description serve to explain the principles of some embodiments of the invention:

FIG. 7 is a schematic illustration of elements generated and sorted for a game in accordance with one or more embodiments of the present invention;

FIG. 8 is a diagrammatic representation of elements which are assigned to locations to be selected;

FIG. 13 describes a method in accordance with one or more embodiments of the present invention.

DETAILED DESCRIPTION

Applicants have recognized that some types of players would find it desirable to believe that all possible elements of a game are available for selection (e.g., by the player and/or the gaming device) during a game. Some embodiments of the present invention thus provide the benefit that one or more of the set of all possible elements may be displayed or otherwise communicated to the player, for example, before the player makes a selection. By revealing one or more elements to a player in this way, the player may become more confident that all possible elements are available for selection, and thus may feel as though he has a greater influence over an outcome of the game.

In accordance with various embodiments of the present invention, a player influences the outcome of a game by being able to select from among all possible elements of a game. Applicants have recognized that such an ability to select from all possible elements significantly increases player enjoyment due to an increased illusion of control. Since a player is able to select from among all possible elements of a game, he is able to obtain any possible outcome through appropriate selection. Thus, he is theoretically able to win a maximum payout each time he plays, thereby providing an illusion of control much greater than that provided by known electronic gaming devices.

Of course, the player's ability to select from among all possible elements does not necessarily change the probability of his winning or even his average payout. However, if he loses, he is less likely to blame the machine, and more likely to attribute the loss to his poor or "unlucky" selection. Thus, the player is more likely to continue playing.

As will be understood by those skilled in the art, the drawings and accompanying descriptions presented herein are exemplary arrangements for stored representations of information. A number of other arrangements may be employed besides the tables shown. Similarly, the illustrated entries represent exemplary information, but those skilled in the art will understand that the number and content of the entries can be different from those illustrated herein.

As will also be understood by those skilled in the art, a set of random numbers is an unpredictable sequence of numbers in which no number is any more likely to occur at a given time or place in the sequence than any other. Although truly random number generation is generally viewed as impossible, as used herein, the term "random number" will include the well-known process of generating random numbers with a computer ("pseudorandom number generation").

Figure 1:
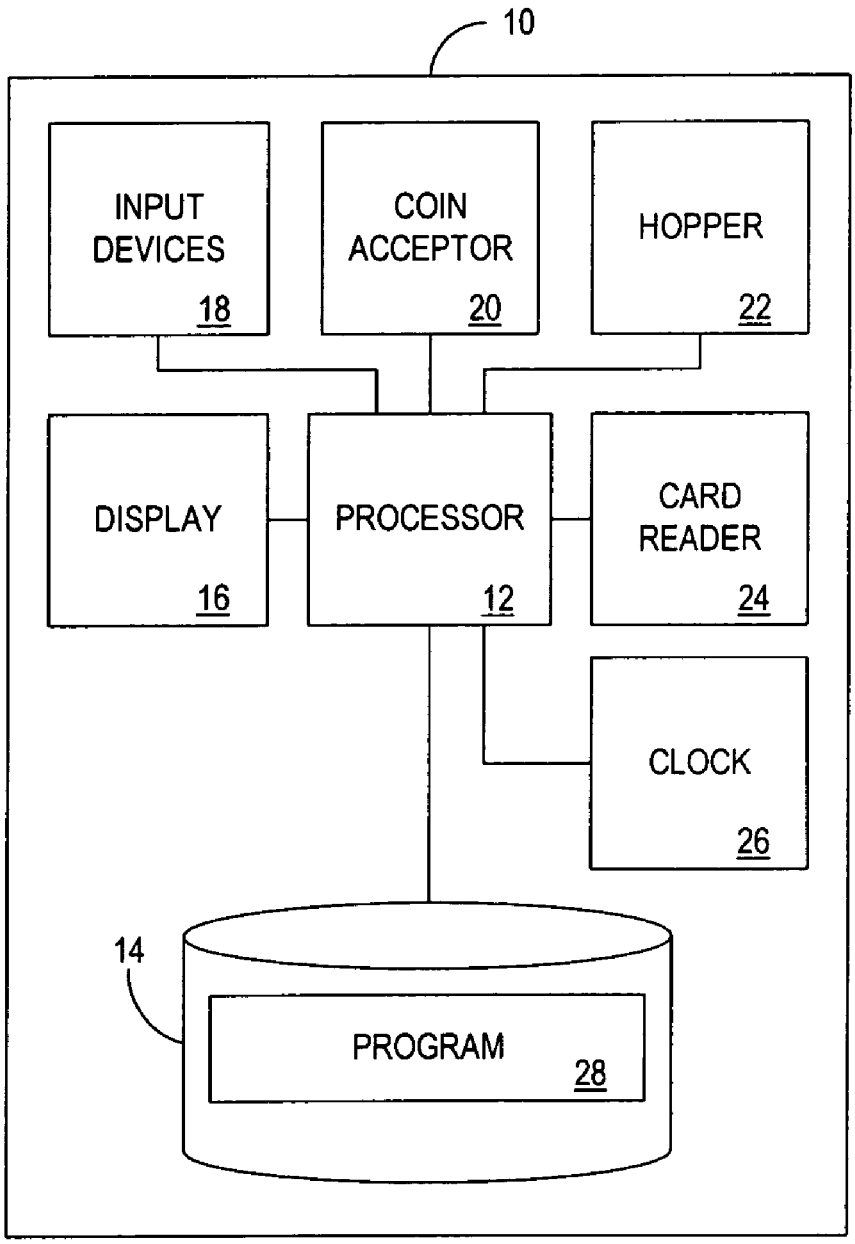
FIG. 1 is a schematic illustration of an electronic gaming device provided in accordance with one or more embodiments of the present invention.

FIG. 1 illustrates an embodiment of a gaming device 10. Well-known examples of gaming devices include, without limitation, slot machines. Well-known examples of slot machines include, without limitation, video poker machines, video blackjack machines, mechanical slot machines, video slot machines, video keno machines, video bingo machines, pachinko machines, and video lottery terminals. The gaming device 10 may be implemented as a dedicated hardware circuit, an appropriately programmed general-purpose computer, or any other appropriate device including, without limitation, electronic, mechanical or electro-mechanical devices. Accordingly, the gaming device need not include the various exemplary components depicted in FIG. 1.

Referring to FIG. 1, a gaming device 10 comprises a processor 12, such as one or more conventional microprocessors, which is in communication with a data storage device 14, such as an appropriate combination of magnetic, optical and/or semiconductor memory. The processor 12 and the storage device 14 may each be (i) located entirely within a single computer or other computing device; (ii) connected to each other by a remote communication link, such as a serial port cable, telephone line or radio frequency transceiver; or (iii) a combination thereof. For example, the gaming device 10 may comprise one or more computers which are connected to a remote server computer for maintaining databases.

The processor 12 is further in communication with a display 16 and player input devices 18. The display 16 is a graphical display device, such as a video monitor of a type used in conventional electronic gaming devices, for displaying images generated by the processor 12 during a game. Examples of such images are described below. The player input devices 18 include input devices well known in the art, such as a touch screen for generating a signal indicative of a location on the touch screen that is touched or pressed by a player, and/or buttons which indicate player commands and selections when actuated. Other input devices will be understood by those skilled in the art.

The processor 12 is further in communication with a coin acceptor 20 for generating a signal indicative of the number of coins inserted and their type. The coin acceptor 20 thereby allows the processor 12 to determine an amount of funds which are deposited by a player and retained in a coin reservoir (not shown). A hopper 22 for dispensing coins from the coin reservoir (not shown) is in communication with the processor 12. When the player requests to "cash out" (receive all funds he is due), the processor determines if the player is due any funds ("credit"). If so, the processor 12 directs the hopper 22 to release an appropriate number and type of coins in a known manner.

The processor 12 is further in communication with a card reader 24 for reading information stored on a player tracking card (not shown). Such a player tracking card may be magnetically encoded with data representing an amount of funds, and/or with data representing a player identifier, such as a player name or account number. Accordingly, a player may use a player tracking card instead of inserting coins into and receiving coins from the gaming device 10. The player identifier can be used in accessing other player-related information stored on a network server or other remote device, as is described below. Thus, the card reader 24 also allows the processor 12 to receive and transmit player-related information. The card reader 24 may also include a display for displaying the value of funds stored in association with a player tracking card, thereby informing the player of an amount of funds available.

A clock 26 in communication with the processor 12 periodically generates signals that indicate time. Thus, the processor may ascertain the time of day or the time that has elapsed between two events.

The storage device 14 stores a program 28 for controlling the processor 12. The processor 12 performs instructions of the program 28, thereby operating in accordance with various embodiments of the present invention, and particularly in accordance with the methods described in detail herein. For example, the program 28 stores data indicative of game rules and elements. The program 28 may be stored in a compressed, uncompiled and/or encrypted format, as well as in a variety of other forms known in the art. The program 28 furthermore includes program elements that may be necessary, such as an operating system and "device drivers" for allowing the processor to interface with computer peripheral devices, such as the hopper 22 and the card reader 24. Appropriate device drivers and other necessary program elements are known to those skilled in the art, and need not be described in detail herein.

According to some embodiments of the present invention, the instructions of the program 28 may be read into a main memory from another computer-readable medium, such as into RAM from a hard drive or ROM. Execution of sequences of the instructions in program 28 causes processor 12 to perform process steps described herein. In alternative embodiments, hard-wired circuitry may be used in place of, or in combination with, software instructions for implementation of the processes of the present invention, as would be understood by those of skill in the art. Thus, embodiments of the present invention are not limited to hardware, software or any specific combination of hardware and software.

According to some embodiments of the present invention, the gaming device 10 is an electronic or electromechanical device similar to those installed in casinos. As such, the gaming device 10 may include typical components such as the coin acceptor 20, the hopper 22 and/or the card reader 24. In some embodiments, the gaming device 10 may be implemented as software that directs one or more computers, such as conventional personal computers based on one or more INTEL PENTIUM® microprocessors. Furthermore, such software implementations of the gaming device 10 may be operative to implement gaming over networks, such the Internet.

Figure 2:
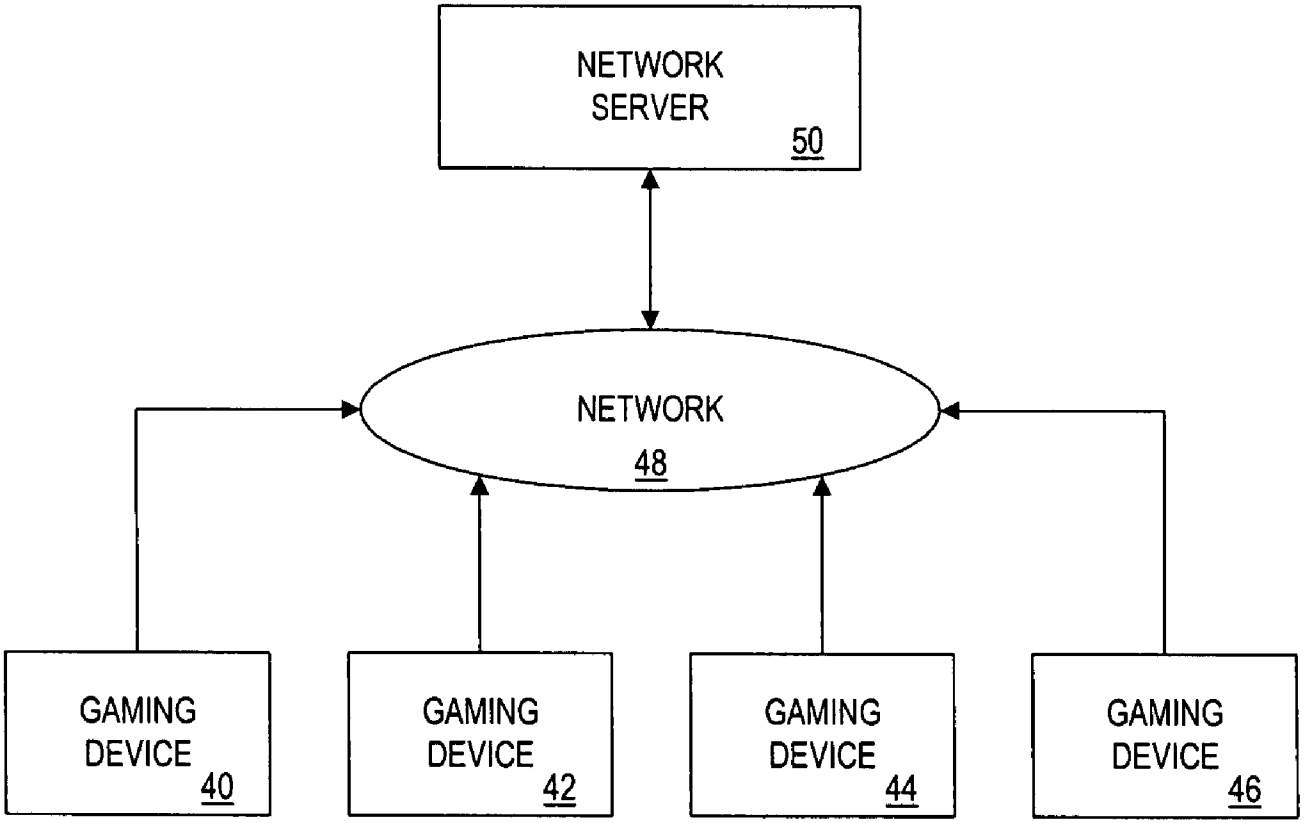
FIG. 2 is a schematic illustration of a plurality of gaming devices which are in communication with a network server.

Referring to FIG. 2, each of gaming devices 40, 42, 44 and 46 is in communication with a network 48, and is thereby in communication with a network server 50. Communication with the network server 50 allows each gaming device to access player-related information stored on the network server. Those skilled in the art will understand that many types of player-related information may be stored, such as funds and predefined game preferences. Those skilled in the art will also understand that many types of gaming devices may operate in communication with a network server, while many others may operate without any such communication to another device.

The network server 50 may be implemented, for example, as a system controller, a dedicated hardware circuit, an appropriately programmed general-purpose computer, or any other appropriate device including, without limitation, electronic, mechanical or electromechanical devices.

Each of the gaming devices may comprise one or more computing devices, such as those based on the Intel® Pentium® processor, adapted to communicate with the network server 50, and/or may comprise a personal computer; a portable type of computer, such as a laptop computer, a palm-top computer, a wearable computer, or a hand-held computer; and/or a Personal Digital Assistant (PDA). Other equivalent devices capable of performing the methods specified herein are well known in the art.

Any number of gaming devices may be in communication with the network server 50. The number of gaming devices depicted in FIG. 2 is solely for purposes of illustration.

The network server 50 may communicate with one or more gaming devices directly or indirectly. Communication may take place, for example, via the network 48, which may include, without limitation, the Internet, wireless network protocol, local area network or a combination thereof; through a Web site maintained by the network server 50 on a remote server; or over an on-line data network including, without limitation, commercial on-line service providers and bulletin board systems. In yet other embodiments, the gaming devices may communicate with the network server 50 over RF, cable TV, satellite links and the like.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for weeks at a time.

The network server 50 may function as a "Web server" that generates Web pages (documents on the Web that typically include an HTML file and associated graphics and script files) that may be accessed via the Web and allows communication with the server 102 in a manner known in the art.

FIG. 2 depicts only an exemplary embodiment of the invention. Other arrangements of devices to perform various methods specified herein will be readily appreciated by those of skill in the art.

Many games are characterized by a plurality of elements. Selection of one or more of these elements (a subset of elements) determines an outcome of the game. In accordance with one or more embodiments of the present invention, every time a player plays the game he is allowed to select from a set that includes each possible element of the game. Thus, the ability to select any element, and thereby to attain the highest-value outcome, is in the control of the player every time he plays.

Figure 3:
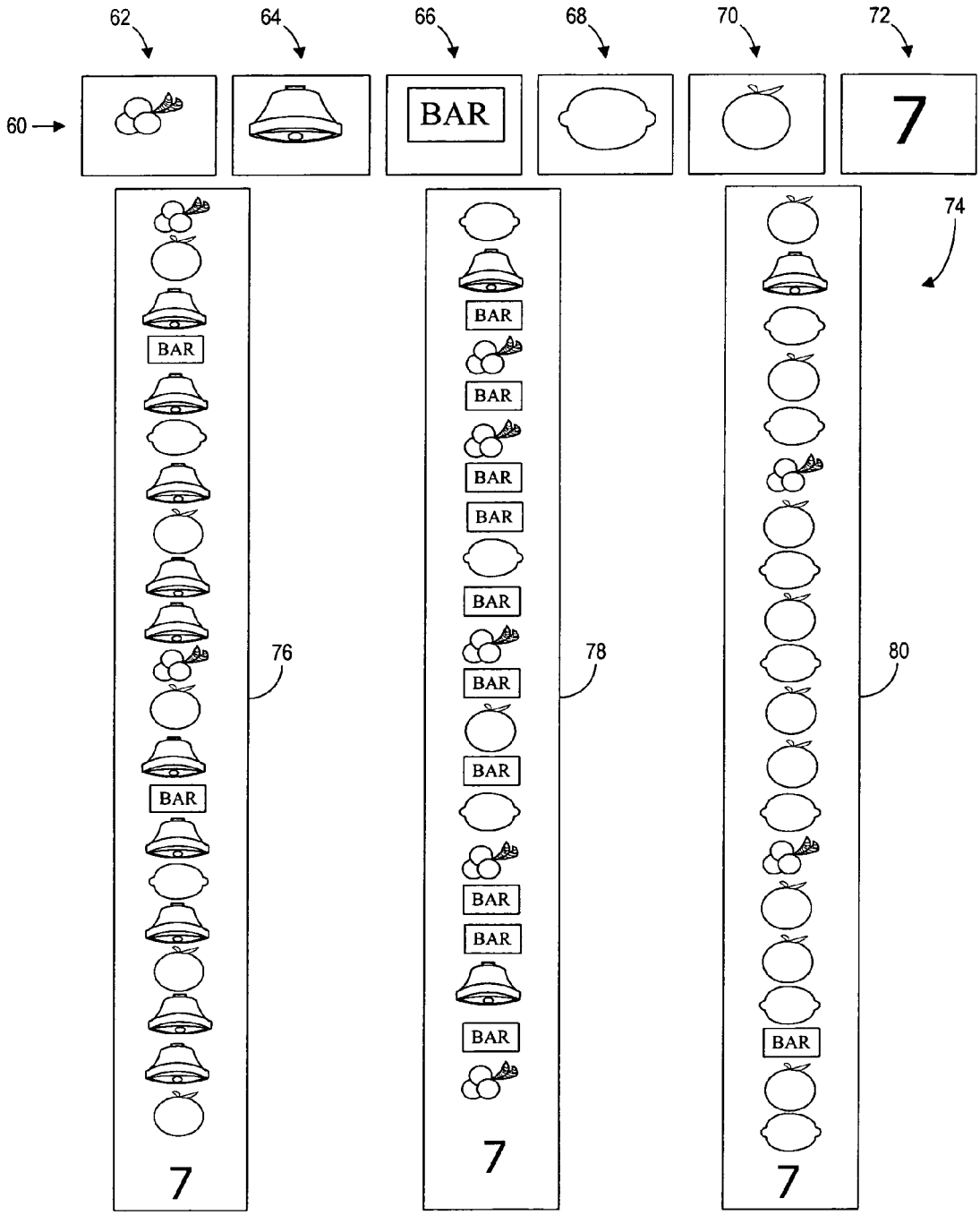
PRIOR ART FIG. 3
FIG. 3 is a diagrammatic representation of a set of all possible elements of a conventional slot machine-type game, and arrangement of those elements in a conventional slot machine-type game.

Referring to FIG. 3, a set 60 of elements includes all possible elements of a conventional slot machine-type game. The set 60 includes a cherries element 62, a bell element 64, a bar element 66, an orange element 68, a plum element 70 and a seven element 72. During a game, the device randomly selects one element from each of a plurality of reels, yielding a subset of elements that defines the outcome for that game. For example, one possible subset is a bar element, a plum element and a bell element. Another possible subset is an orange element and two cherries elements.

For each reel in a conventional slot machine-type game, the selected element may be one of twenty-two equally likely choices, each choice being one of the set 60 of all possible elements. For example, a plurality 74 of reels includes reels 76, 78 and 80. In a conventional slot machine-type game, the player is randomly provided with, but does not select, an element chosen from each of the reels 76, 78 and 80, thereby yielding a subset that consists of three elements. The three elements define the outcome, and therefore a payout. However, because the player does not select any elements, he lacks the illusion of control which makes the game more desirable.

It is noted that the number of choices in a game is greater than the number of elements. For example, although there are six elements 62, 64, 66, 68, 70 and 72, there are twenty-two choices on each reel, and therefore there are 10,648 possible outcomes for each game (22×22×22=10,648).

Figure 4:
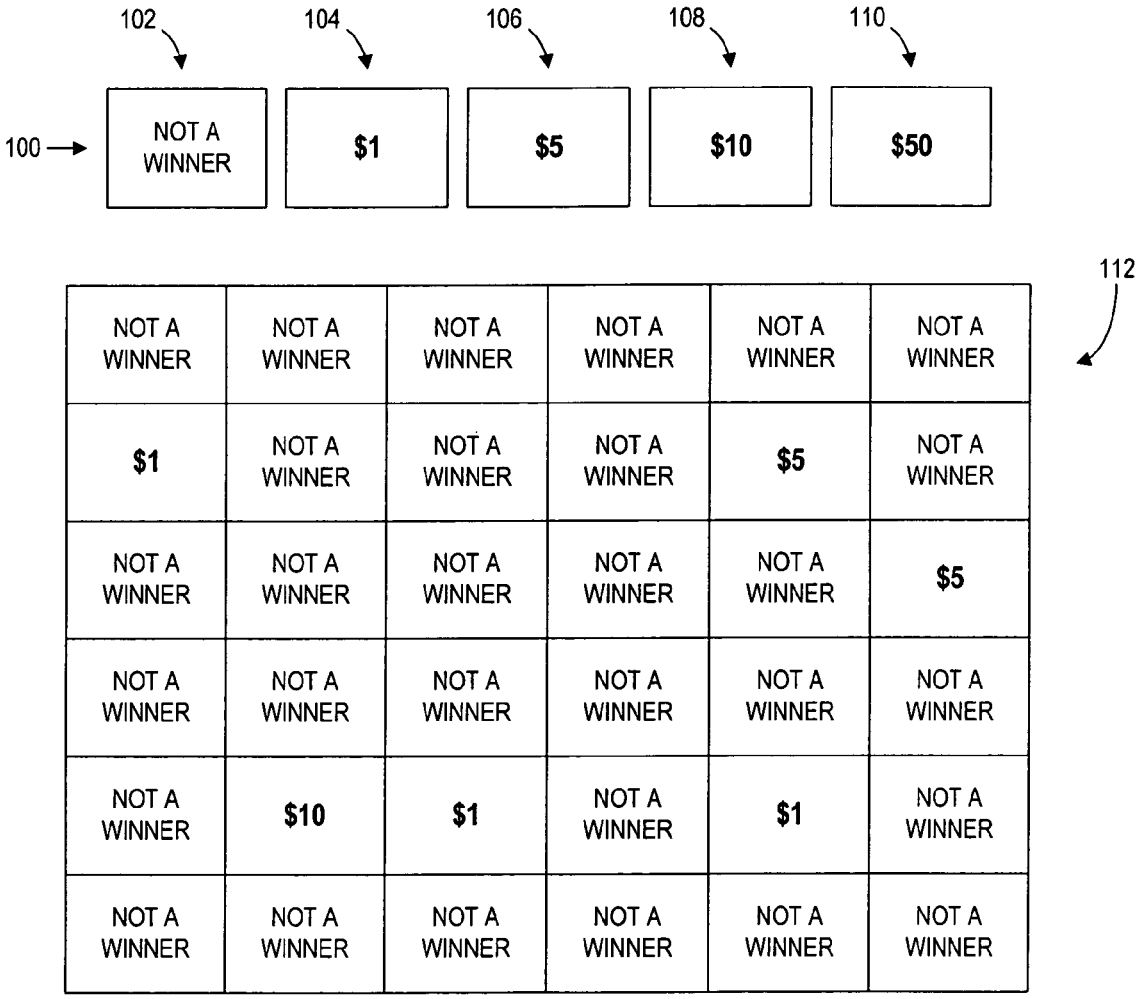
PRIOR ART FIG. 4
FIG. 4 is a diagrammatic representation of a set of all possible elements of a conventional punchboard-type game, and arrangement of those elements in a conventional punchboard-type game.

Referring to FIG. 4, a set 100 of elements includes all possible elements of a conventional punchboard-type game. The set 100 includes a "not a winner" element 102, a $1 element 104, a $5 element 106, a $10 element 108 and a $50 element 110. In this type of game, each element corresponds to an outcome (i.e. a dollar value won, if any). Thus, each element defines an outcome, and the set 100 therefore includes all possible outcomes of the game. During a conventional punchboard-type game, the player selects one element from a plurality of randomly-generated possible selections 112, yielding an element that defines the outcome and payout for that game. Of course, each of the possible selections 112 is typically hidden or obscured until selected by the player. It is noted that although there are five elements 102, 104, 106, 108 and 110, the plurality of possible selections 112 includes thirty-six possible choices. Thus, a player indicates which of the thirty-six locations he selects, and the element corresponding to the selected location defines the outcome. Unfortunately, in the exemplary plurality of possible selections 112, not all possible elements are included. In particular, there is no element representing the maximum payout ($50 element 110). Accordingly, the player could not possibly attain the maximum payout in a conventional game corresponding to the example illustrated by the plurality of possible selections 112.

In summary, for each game there is defined a set of elements. In conventional electronic gaming devices, such as illustrated by FIGS. 3 and 4, which allow a player to select elements, the player may only select from a group that does not contain all possible elements of a game. The player thus does not significantly enjoy the illusion of control, and may feel that a loss is predetermined. By contrast, in various embodiments of the present invention the set from which the player selects includes all possible outcomes of a game.

Figure 5:
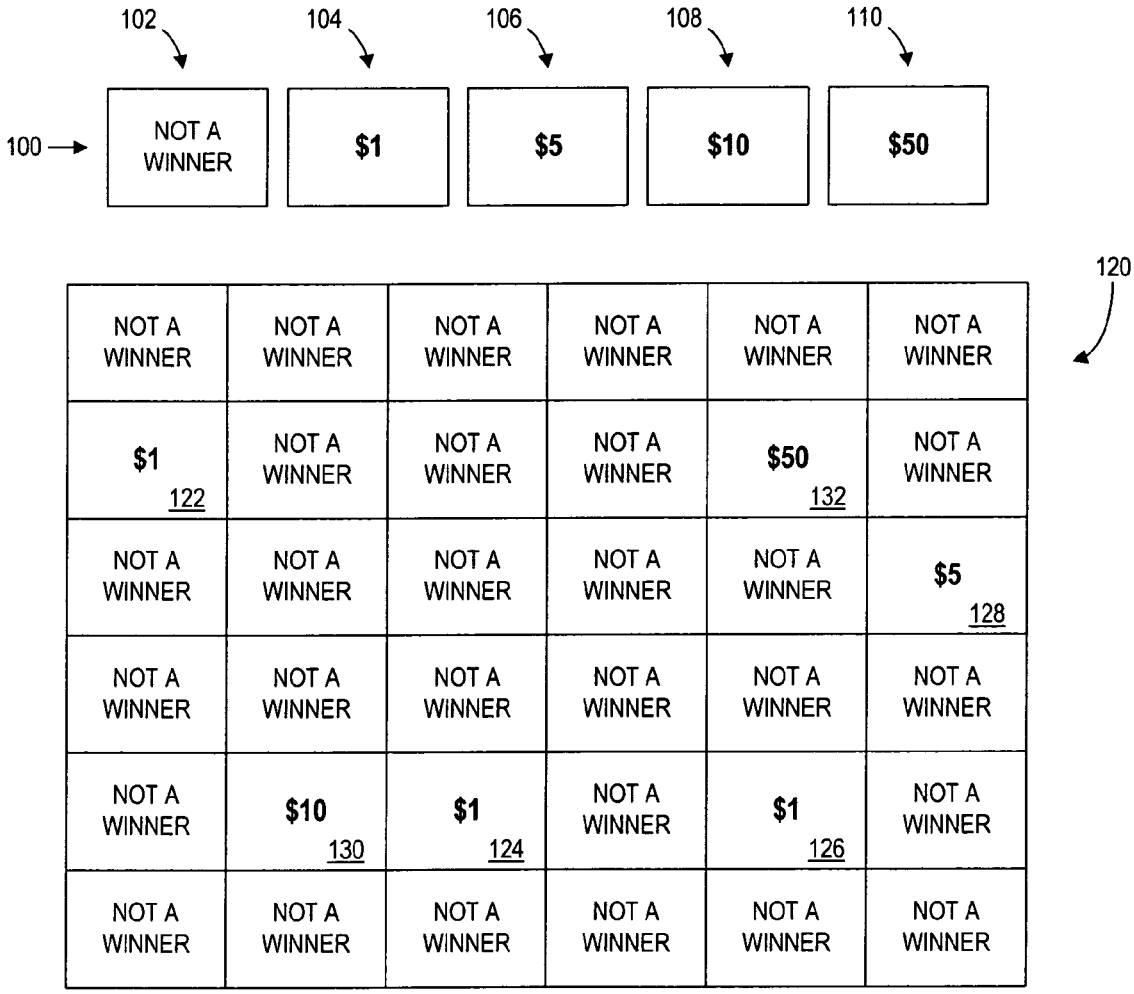
FIG. 5 is a diagrammatic representation of a set of all possible elements of a punchboard-type game, and arrangement of those elements in a punchboard-type game provided in accordance with one or more embodiments of the present invention.

Referring to FIG. 5, the set 100 of all possible elements of a punchboard-type game is illustrated again. In addition, each of a plurality of locations 120 defines a possible selection. The plurality of locations 120 includes each element of the set 100 of all possible elements, and so each element of the set 100 may be selected by a player. In accordance with some embodiments of the present invention, each of the elements 102, 104, 106, 108 and 110 is assigned to at least one of the plurality of locations 120. For example, the $1 element 104 is assigned to locations 122, 124 and 126, the $5 element 106 is assigned to location 128, the $10 element 108 is assigned to location 130, the $50 element 110 is assigned to location 132 and the "not a winner" element 102 is assigned to the remaining locations in the plurality of locations 120. The assignment of each possible element to at least one location is random, and is described in detail below. A player selects one element from the plurality of locations 120 by operating one or more of the player input devices 18 (FIG. 1).

Figure 6:
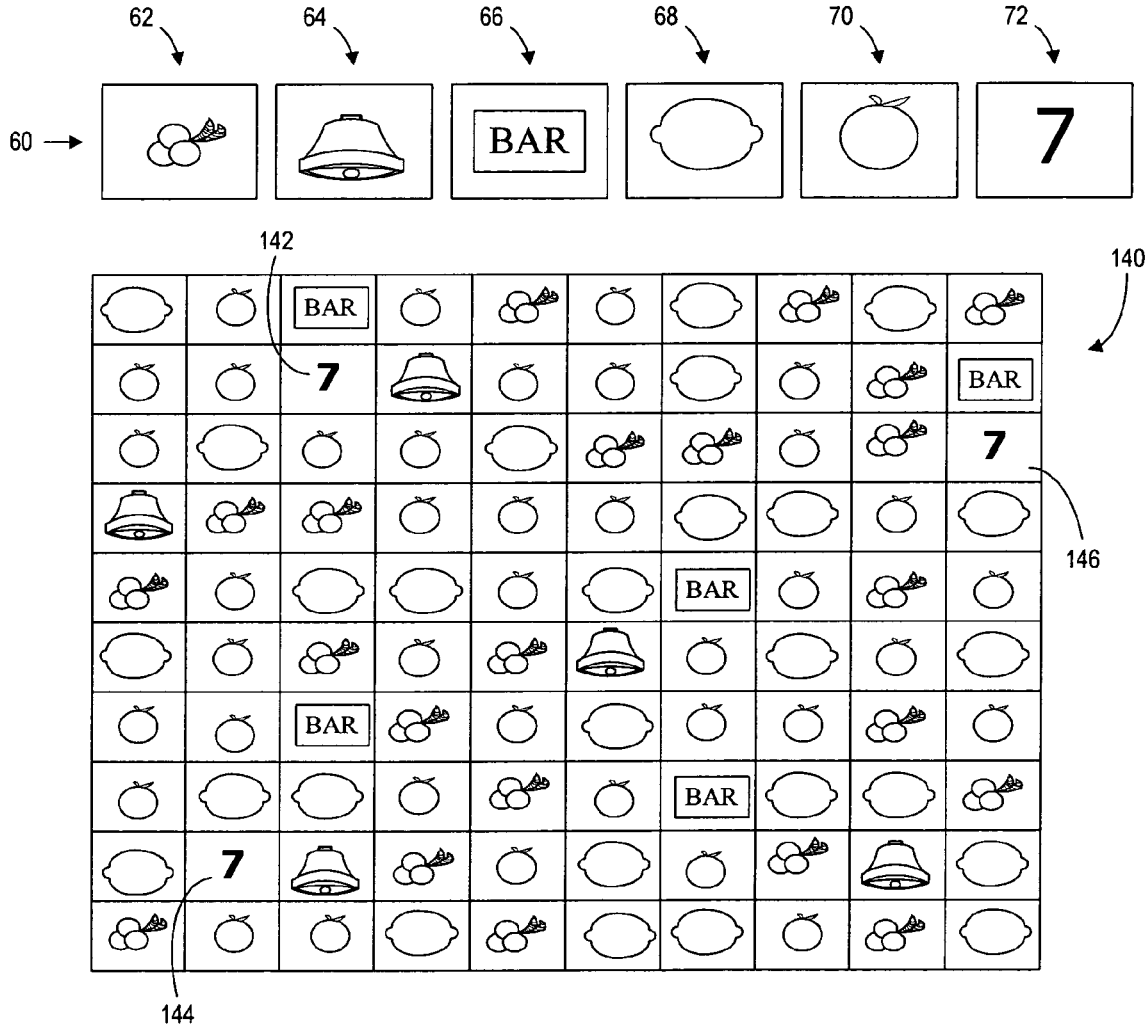
FIG. 6 is a diagrammatic representation of a set of all possible elements of a slot machine-type game, and an exemplary arrangement of those elements in a slot machine-type game provided in accordance with one or more embodiments of the present invention.

Referring to FIG. 6, the set 60 of all possible elements of a slot machine-type game is illustrated again. In addition, each of a plurality of locations 140 defines a possible selection. In accordance with various embodiments of the present invention, each of the elements 62, 64, 66, 68, 70 and 72 is assigned to at least one of the plurality of locations 140. In particular, the seven element 72 is assigned to locations 142, 144 and 146. During each game, the player selects three locations from the plurality of locations 140, thereby defining a subset of three elements that defines the outcome and payout for that game. Of course, each of the plurality of locations 140 is hidden or obscured until selected by the player. In the example illustrated by FIG. 6, during every game the player has a 0.0006% chance of selecting the three "seven" elements (3/100×2/99×1/98=6/970,200=0.000006).

According to one or more embodiments of the present invention, when an element is hidden or obscured, it may be "hidden behind" or otherwise represented by a generic symbol, such as, without limitation, an opaque square (e.g., in a displayed grid) or other shape. The representations of hidden elements may be identical, or one or more may differ in the displayed size, shape, color, image, label, animation, etc.

FIG. 7 illustrates one method for randomly assigning each possible element to at least one location in a punchboard-type game provided in accordance with some embodiments of the present invention. In particular, the method illustrated by FIG. 7 assigns each element of the set 100 to at least one of thirty-six locations. The gaming device 10 (FIG. 1) first generates a table 160 that defines, for the thirty-six locations, a number of occurrences of each element of the set 100. Accordingly, the sum of the occurrences of each element is thirty-six.

A series 170 of thirty-six elements is generated in accordance with the table 160. The series 170 thereby defines the occurrences of each element of the set 100. The gaming device 10 (FIG. 1) also generates a series 180 of random numbers which are used to define the assignment of each of the elements of the series 170 to a location. Each random number of the series 180 indicates a location of the corresponding element of the series 170. For example, the first random number of the series 180 defines the position of the first element of the series 170 in a manner described below.

The gaming device generates a series 190, which is a sorted series of the random numbers of the series 180. The sorted series 190 thereby also defines a sorted series 200 of elements. The sorted series of elements 200 correspond to the series 170 which has been sorted in accordance with the order of the sorted series 190 of random numbers, thereby maintaining the correspondence between elements and random numbers defined by the series 170 and 180. Thus, just as each random number of the series 180 corresponds to an element of the series 170, a matching random number may be found in the series 190 in correspondence with a matching element in the series 190. For example, in the series 180, the first-listed random number 0.29 corresponds to the first element $50. Accordingly, the random number 0.29 in the series 190 also corresponds to the element. $50.

Furthermore, each element of the sorted series 200 of elements corresponds to a location. For example, the first element of the sorted series 200 corresponds to a first location, and the thirty-sixth element of the sorted series 200 corresponds to a thirty-sixth location. Referring to FIG. 8, a table 210 defines a set of thirty-six locations that appear on the display 16 (FIG. 1), and which represent the possible choices from which a player selects an element in a punchboard-type game. Each location is numbered in accordance with the numbering shown in the table 210. In particular, the table 210 illustrates that the player is presented with a six-by-six array of possible choices. The gaming device associates each location with the corresponding element of the sorted series 200 of elements, thereby defining a table 220 of elements assigned to the thirty-six locations. For example, if the player selects the element in the second row and the third column (location number fourteen), he selects the $50 element. The fourteenth element of the series 200 is the $50 element. As described above, each of the thirty-six locations is obscured until selected by the player, although the table 220 shows each element.

Figure 9:
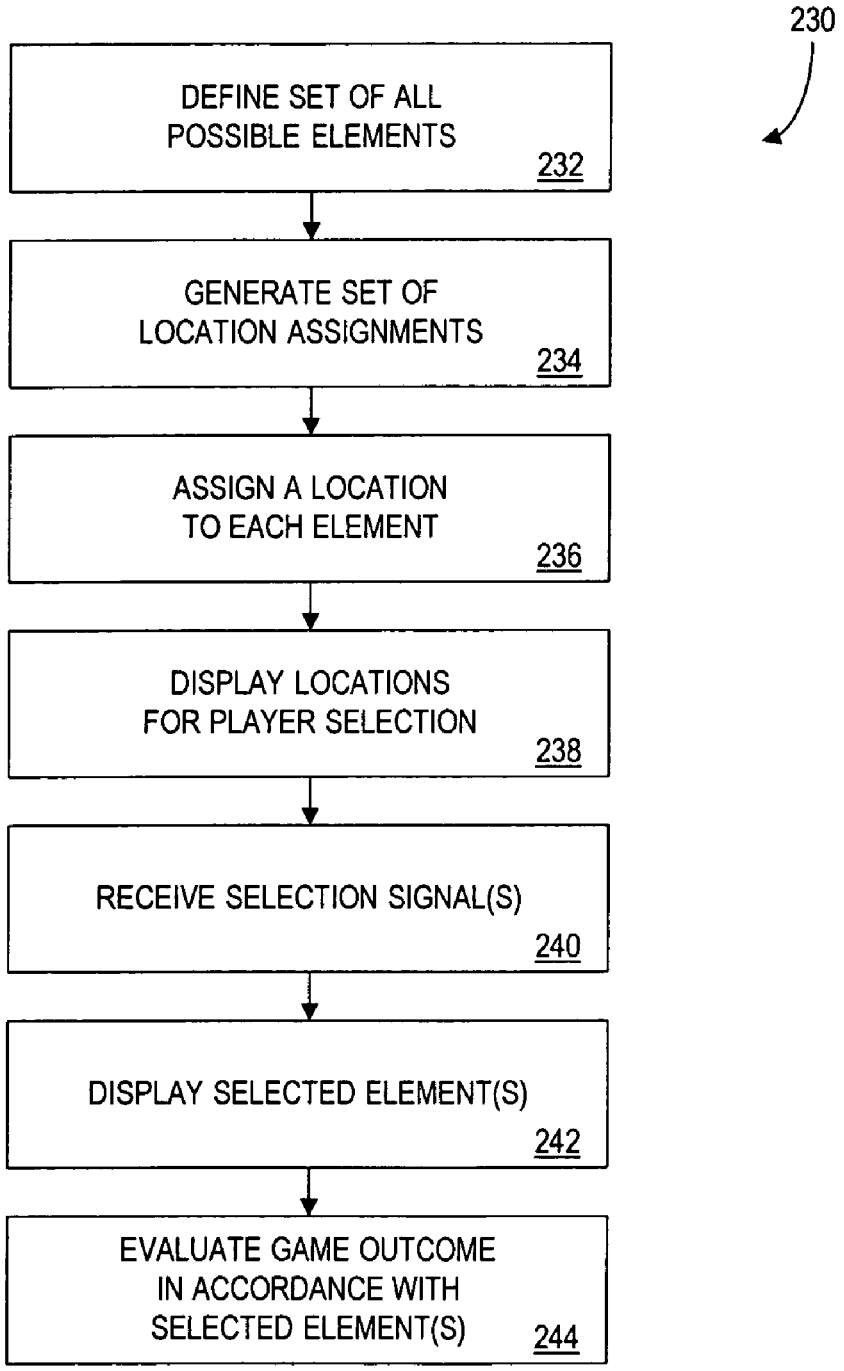
FIG. 9 is a flow chart illustrating a method in accordance with one or more embodiments of the present invention for facilitating play of a game.

Referring to FIG. 9, a flow chart represents an exemplary embodiment of the present invention that may be performed by a gaming device, including, without limitation, a slot machine. The particular arrangement of elements in the flow chart of FIG. 9, as well as the other flow charts discussed herein, is not meant to imply a fixed order to the steps; the steps can be practiced in any order that is practicable for various embodiments of the present invention.

Referring to FIG. 9, a method 230 initiates with the electronic gaming device 10 (FIG. 1) defining a set of all possible elements of a game (step 232). This set may be defined in many known ways. Typically, the gaming device 10 defines the set by storing a table of elements and corresponding graphical representations, and further storing rules defining the occurrence rate of each element. The gaming device 10 further generates a set of location assignments for each of the elements (step 234), and assigns a location to each element in accordance with the set of location assignments (step 236). The player is presented with locations and prompted to select one or more locations, depending on the type of game (step 238). The player may also be presented with game hints (predetermined text which depends on the status of each game), possibly for a fee (extra payment) or in return for a "preferred player" status indicated by the network server 50 (FIG. 2). The displayed locations to select are typically arranged in one or more rows of possible selections. Alternatively, the displayed locations to select may be represented as a three-dimensional layout. Furthermore, although typically each of the possible selections is hidden or obscured until selected by the player, it may be desirable to temporarily reveal some of all elements to the player before his selection is made, thereby introducing the player's memory ability into the game.

The player provides his selection(s) via one or more of the input devices 18 (FIG. 1), and one or more corresponding selection signals are received by the gaming device 10 (step 240). In an embodiment where elements are revealed to the player, the gaming device 10 may require that selection(s) are provided within a predetermined time of the revealing. In an alternate embodiment, the player has predefined selections that are stored on the network server 50 (FIG. 2). In such an embodiment, the selection signals would be transmitted from the network server 50 and received by the gaming device 10. Each received selection signal indicates an element from the set of possible elements. The selected elements are displayed (step 242), either after each selection is made, or after all selections are made. The gaming device 10 evaluates an outcome of the game in accordance with the selected elements (step 244). Such evaluation may be performed by comparing the selected elements with predefined subsets, each predefined subset defining a predefined outcome. Thus, the gaming device 10 can determine an outcome that corresponds to a predefined outcome (e.g. a $10 payout). For example, in a slot machine-type game, such as illustrated by FIG. 6, a predefined subset consisting of three instances of the seven element 72 (FIG. 6) may define an outcome comprising one hundred thousand times the amount wagered. In a poker-type game, a predefined subset consisting of four cards of equal rank may define an outcome comprising twenty five times the amount wagered. In addition, depending on the type of game, the outcome may or may not be based on the order in which the elements are selected.

It is noted that the above description of element selection is applicable to many types of games, such as games in which each element represents a playing card value. As is known in the art, a card value is defined by a rank (2 through 10, jack, queen, king or ace) and suit (clubs, spades, diamonds or hearts). Accordingly, there are at least fifty-two possible elements in a game which employs playing cards (13 ranks×4 suits=52 card values).

Thus, a video poker-type game provided in accordance with one or more embodiments of the present invention may deal a player a hand of five cards, and allow the player to indicate which cards he wishes to hold. The cards not so indicated are discarded, and the player is allowed to select replacement cards from a set of the remaining forty-seven cards (52 cards in the deck−5 dealt cards=47 remaining cards). Alternatively, the player's initial five-card hand may be selected by the player in a like manner. Similarly, in a blackjack-type game provided in accordance with some embodiments of the present invention, the player is presented with a choice of the fifty-two cards from which to select. Two are dealt to the dealer, and from the remaining fifty cards the player selects two cards for his hand. In accordance with the rules of blackjack, the player may select additional cards from those remaining cards. The player thus effectively deals to himself, providing an illusion of control greater than that of video or table blackjack. In another embodiment, the player may select the two cards which the dealer initially receives.

Figure 10:
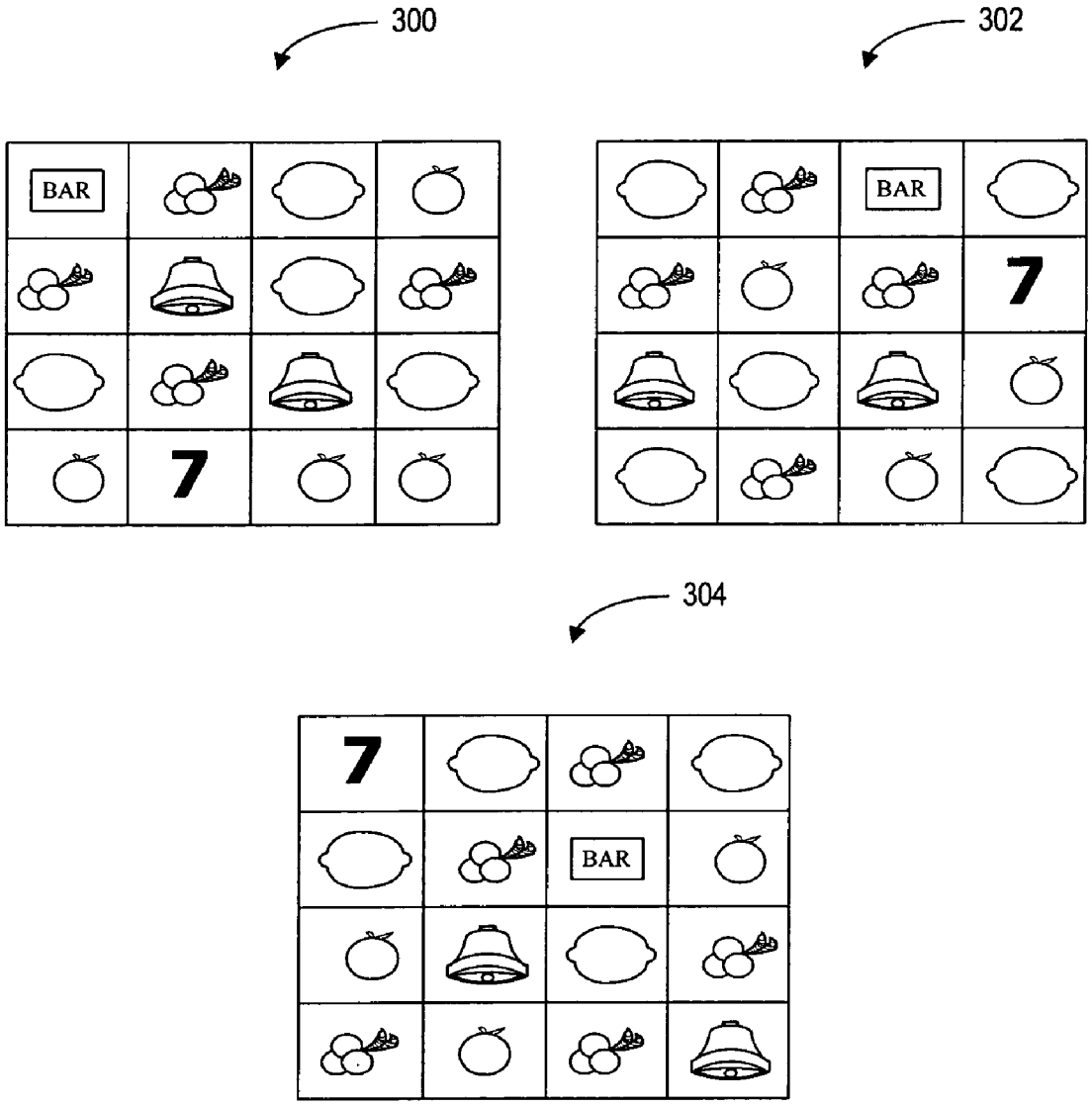
FIG. 10 is a diagrammatic representation of another exemplary arrangement of all possible elements in a slot machine-type game provided in accordance with one or more embodiments of the present invention.

Referring to FIG. 10, another exemplary embodiment of the present invention is described. Groups 300, 302 and 304 of possible selections are displayed, each set including all possible elements. The player selects at least one element from each of the groups 300, 302 and 304. For example, in a slot machine-type game, one symbol would be selected from each group, yielding three selected symbols. The outcome of the game would, in turn, be evaluated in accordance with the three selected symbols.

Figure 11:
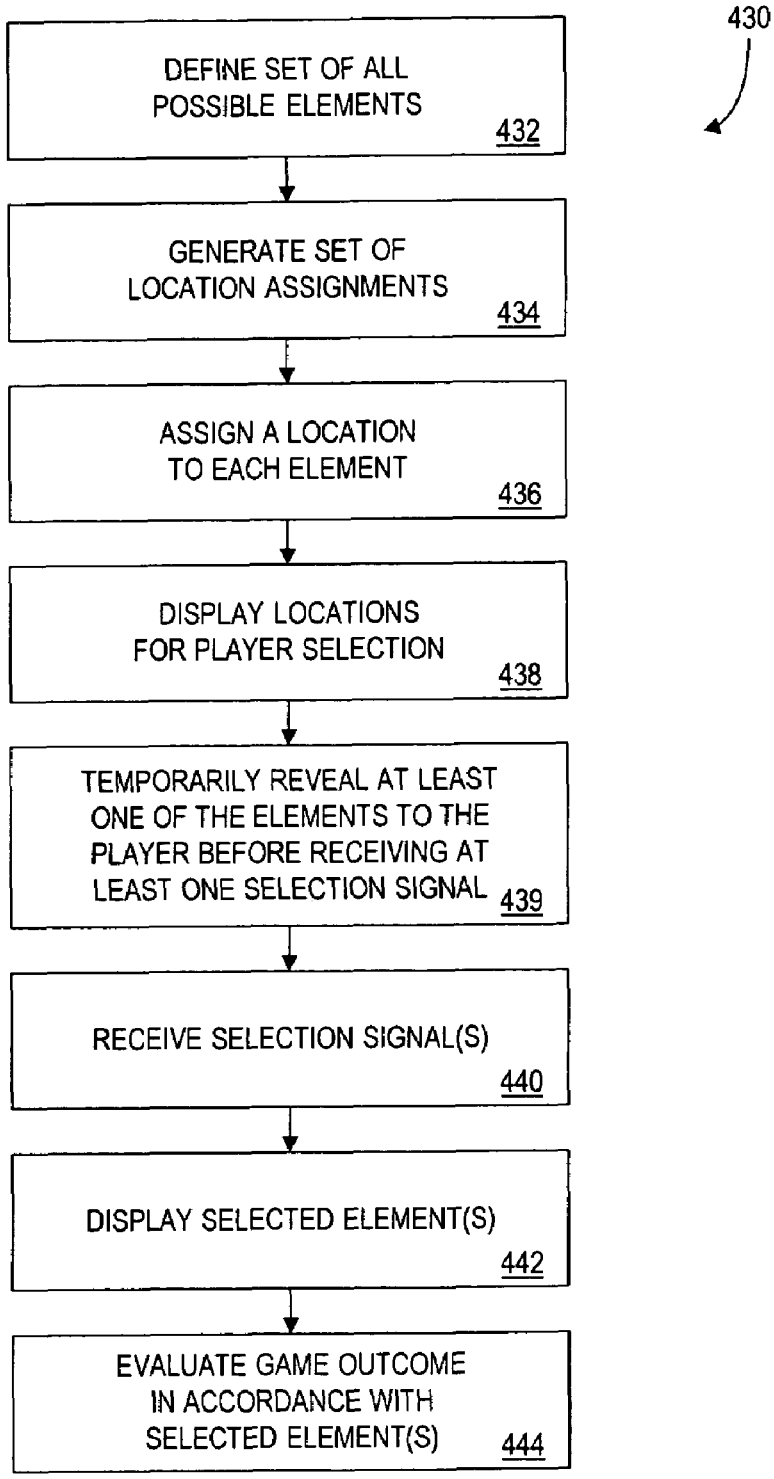
FIG. 11 is a flow chart illustrating a method in accordance with one or more embodiments of the present invention for facilitating play of a game.

Referring to FIG. 11, a method 430 initiates with the electronic gaming device 10 (FIG. 1) defining a set of all possible elements of a game (step 432). The gaming device 10 further generates a set of location assignments for each of the elements (step 434), and assigns a location to each element in accordance with the set of location assignments (step 436). The player is presented with locations and prompted to select one or more locations, depending on the type of game (step 438). At least one of the elements is temporarily revealed to the player before at least one selection signal is received (step 439).

The player provides his selection(s) via one or more of the input devices 18 (FIG. 1), and one or more corresponding selection signals are received by the gaming device 10 (step 440). Each received selection signal indicates an element from the set of possible elements. The selected elements are displayed (step 442), either after each selection is made, or after all selections are made. The gaming device 10 evaluates an outcome of the game in accordance with the selected elements (step 444).

Figure 12:
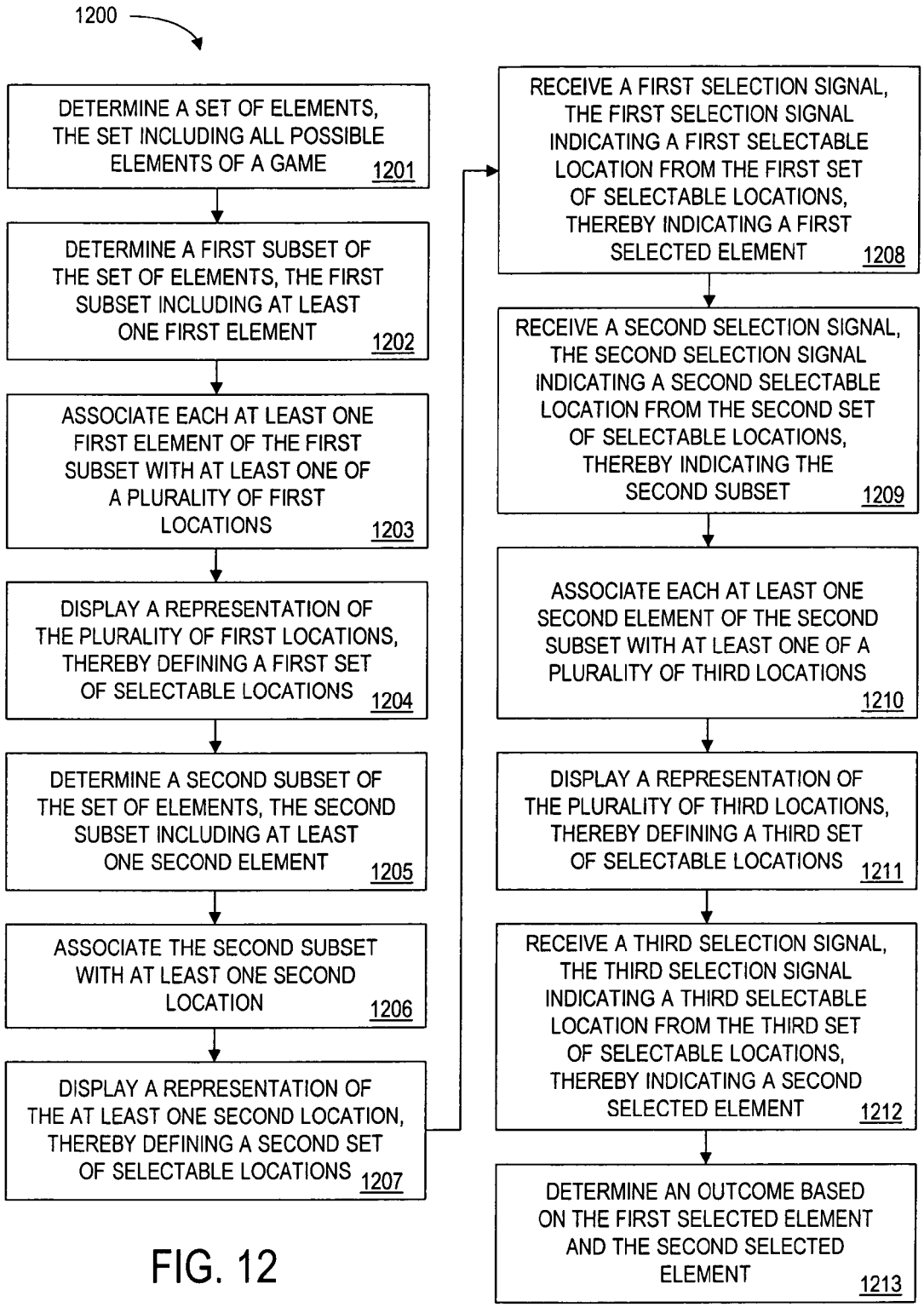
FIG. 12 is a flow chart illustrating a method in accordance with one or more embodiments of the present invention.

Referring to FIG. 12, a plurality of method steps 1200 is depicted. Step 1201 represents determining a set of elements, the set including all possible elements of a game. Step 1202 represents determining a first subset of the set of elements, the first subset including at least one first element. Step 1203 represents associating each at least one first element of the first subset with at least one of a plurality of first locations. Step 1204 represents displaying a representation of the plurality of first locations, thereby defining a first set of selectable locations. Step 1205 represents determining a second subset of the set of elements, the second subset including at least one second element. Step 1206 represents associating the second subset with at least one second location. Step 1207 represents displaying a representation of the at least one second location, thereby defining a second set of selectable locations. Step 1208 represents receiving a first selection signal, the first selection signal indicating a first selectable location from the first set of selectable locations, thereby indicating a first selected element. Step 1209 represents receiving a second selection signal, the second selection signal indicating a second selectable location from the second set of selectable locations, thereby indicating the second subset. Step 1210 represents associating each at least one second element of the second subset with at least one of a plurality of third locations. Step 1211 represents displaying a representation of the plurality of third locations, thereby defining a third set of selectable locations. Step 1212 represents receiving a third selection signal, the third selection signal indicating a third selectable location from the third set of selectable locations, thereby indicating a second selected element. Step 1213 represents determining an outcome based on the first selected element and the second selected element.

Referring to FIG. 13, a method 1300 is depicted. As indicated, the method 1300 comprises: determining a set of elements, the set including all possible elements of a game; displaying a representation of each element of the set of elements; after said displaying, associating each of the elements of the set with at least one of a plurality of locations; after displaying the representation of each element of the set of elements, displaying a representation of the plurality of locations to a player, thereby defining a set of selectable locations; receiving at least one selection signal, each selection signal indicating a selectable location from the set of selectable locations, the at least one selection signal thereby indicating at least one selected element; and determining an outcome based on the at least one selected element.

Additional Embodiments

Although the present invention has been described with respect to various preferred embodiments thereof, those skilled in the art will note that various substitutions, deletions, additions, and/or modifications may be made to those embodiments described herein without departing from the spirit and scope of the present invention. In addition, other types of games, such as bingo and keno, are also anticipated by the disclosure of the present invention.

Although the above-described embodiments illustrate that the gaming device evaluates an outcome of the game in accordance with the selected elements, the outcome may further depend on other randomly-generated data. For example, the gaming device may generate one or more cards, the player may select one or more additional cards from those remaining, and then the gaming device would evaluate an outcome in accordance with all selected cards.

Alternatively, the gaming device may randomly generate a subset of elements to determine a base payout, and the player selects at least one additional element. For example, a player-selected element could determine a multiplier on the base payout. In another example, an element selected by a player could indicate an amount (e.g., a number of reel stops) by which a reel will turn. For instance, a "5" symbol would direct a reel to advance five stops. In another example, a player-selected element could indicate a starting position from which one or more reels will be spun. In yet another example, selected elements could indicate the speed at which one or more reels will spin and/or the amount of time that one or more reels will spin. According to another example in which play is automated for the player, a selectable element could indicate an amount of time between automated plays (e.g., handle pulls).

As described above with respect to some embodiments of the present invention, it may be desirable to temporarily reveal one or more elements to the player before a selection is made. For instance, it may be desirable to temporarily reveal one or more elements to the player at the location from which they may be selected, thereby introducing the player's memory ability into the game. Some players may find it desirable not to have to memorize what element is associated with a location. Thus, according to some embodiments of the present invention, one or more elements may be selected by the player while revealed. For instance, a gaming device may display a grid of selectable locations of cards, in which at least one location displays a card face up (e.g., the element is revealed).

It also may be desirable to reveal at least one element first to the player at a location that is different than the one from which it then may be selected (e.g., by "moving" the element, after revealing it, to a location from which it may be selected). For instance, an element may be revealed before the location from which the player can select the element has been displayed, and/or before the element has been assigned to or otherwise associated with a respective selectable location. Any displayed or revealed elements may then be concealed and/or may also be rearranged or moved. In one example, the player is allowed to see all possible cards of a card game displayed at once. Then, the representations of the cards are virtually "shuffled" and dealt face down at locations selectable by the player. In this example, none of the cards in the revealed deck of cards could be selected; the player had to wait until the cards were dealt out.

Some players may find the initial revealing of some or all possible game elements desirable, as it indicates to the player that certain game elements are truly available for selection by the player (even if the elements are subsequently concealed and/or rearranged before a selection can be made). This may further increase the perception by a player that he has a degree of control over a game outcome.

There are various ways in which one or more elements may be displayed or revealed to a player. According to one or more embodiments, elements may be revealed in an "ordered" state. Examples of how elements may be revealed include, without limitation:

Arrangement by color and/or type of element. For example, all green symbols of the set of possible elements are shown in one area, all red symbols are shown in another area, and all blue symbols in a third area. The player may thus be able to estimate the relative numbers of red, blue and green symbols by looking at the sizes of their respective display areas, rather than by counting symbols individually. In another example, green jellybeans may be displayed in one stack, red jellybeans in another, and so on. The size of the stack may thus give the player a quick impression of the number of elements (and/or their relative distribution). In another example, in a game of cards, the ordered state may be that all cards of the same suit are grouped together.

Arrangement by rank. For example, in a game of cards, the ordered state may be that all the cards are shown in rank order (e.g., within each suit).

Numerical arrangement. In any game where symbols are numbers (e.g., in bingo, keno, or roulette), symbols may be displayed in an ascending or descending numerical order.

Arrangement in accordance with a corresponding payout. For example, if complete outcomes are being shown (e.g., a royal straight flush in hearts), the outcomes may initially appear in order of the payout associated with the respective outcome.

Arrangement in accordance with a target or goal. For example, in a puzzle game (e.g., where elements are puzzle pieces and may be used to complete a puzzle), the ordered state may be the elements arranged in the form of a completed puzzle. For instance, "movable" or "slidable" numbered puzzle tiles could be shown in the target numerical order, or a three-dimensional puzzle could be shown in its solved state (e.g., a RUBIK's CUBE® could be shown with each face of the cube being a solid color).

Other criteria for ordering game elements may be described herein, and others may be readily apparent to those having ordinary skill in the art.

It will be understood that an arrangement of elements need not have all displayed elements "fully" ordered according to any particular criteria. For example, although all possible elements may be displayed, it may be desirable that only some of the elements, or one or more types of elements, be ordered or arranged according to one or more criteria. For instance, in a displayed grid of all possible slot symbols, only fruit-themed symbols could be organized by type (e.g., displayed in proximity to other like symbols), and all other types of symbols could appear to be randomly placed in the grid. Of course, as described above, some elements may be displayed while others are hidden or obscured.

In embodiments having an ordered (or at least partially ordered) arrangement, a player may be able to ascertain or perceive various statistical information concerning the elements fairly quickly. In contrast, without some degree of ordering, the set of all possible elements may be too numerous, for example, for the player to count them individually, or to identify them each individually. Knowing (or believing he knows) certain types of information about the selectable elements may make game play more enjoyable for the player, for example, by encouraging a belief that his ability to influence an outcome of the game is improved. Types of information that players may be able to perceive may include, without limitation:

An absolute number of types of elements. An ordered display of all elements may convey to the player how many types of elements are involved in the game. For example, if three distinct "buckets" are displayed, with each bucket containing representations of a different type of symbol, then the player knows there are three types of symbols. In another example, a number of columns may be displayed, with each column containing a different type of symbol; the player can determine the number of types of symbols by counting the number of columns.

The relative numbers or frequencies of types of elements. For example, a player may be convinced, based on a display including all yellow game symbols and all green game symbols of a game, that the yellow symbols outnumber the green symbols by a ratio of about 3:2.

An absolute number of elements. For example, a player may be able to count the absolute number of one or more types of elements (e.g., "jackpot" symbols) more easily if the set of elements is ordered (e.g., all jackpot symbols are displayed in proximity to one another). In contrast, if three jackpot symbols were randomly scattered throughout a large number of other symbols, a player might feel less confident in guessing at how many there were, even if they were of a different color, shape, etc., than other symbols.

As described above, according to some embodiments, if an element is revealed, the element may be revealed at a position from which it later may be selected. According to other embodiments of the present invention, it may be desirable to rearrange one or more revealed elements. Particularly, once an element is revealed (whether in an ordered, partially ordered, random, or unordered arrangement) to a player, its location might be changed before it can be selected. Thus, a symbol may be revealed at a first location and then assigned or moved to a second location before it can be selected.

According to one or more embodiments, a set of symbols may be displayed within a particular display area (e.g., a representation of a grid, a representation of a punchboard) of a display device and then may be rearranged within that particular display area. As described variously herein, the player may then select one or more of the elements. For example, a set of symbols may be displayed in a 10×10 grid, with each symbol corresponding to one grid location, and then one or more of the symbols may swap locations with another symbol within the grid before the player makes a selection.

According to some embodiments, one or more of a set of symbols may be revealed within a first display area of a display device and then may be selectable at a second display area of the display device. Elements may thus be rearranged by transferring them to a new area. For example, a set of symbols (e.g., colored marbles; numbered balls) may be displayed in an ordered state (e.g., separated by color; in a sequential order) at the top of a display screen, and then may be depicted as "spilling down" into a grid area that constitutes the locations from which the symbols may be selected. In another example, symbols may be revealed at a first video display device (e.g., an upper display screen of a gaming device) and then may be selectable in a second video display device (e.g., a lower display screen of a gaming device). Of course, various embodiments of the present invention provide for revealing one or more elements at a first display area, and then rearranging the elements such that one or more elements are selectable at the first display area and one or more elements are selectable from a second display area.

According to various embodiments, an animated representation of one or more elements moving to respective locations may be provided to the player. For example, revealed symbols may be shown to "disappear behind" a representation of a screen having grid markings. Each symbol may then ultimately reside "behind" (or otherwise be associated with) one grid position that may be selectable by the player.

According to some embodiments, one or more revealed elements displayed as being in motion to a final location (e.g., grid location) may become concealed before reaching that location (e.g., before motion begins; while in motion), in such a manner that it is difficult for a player to track a particular element (or elements) to its respective selectable location. For example, one or more of the elements may move quickly, erratically, in convoluted paths of motion, with overlapping paths of motion, and/or may temporarily "blink" out of view (e.g., to reappear at the same or at a different location). The displayed motion may thus make it more difficult for a player to track a particular element in its progress. A player may overestimate his ability to track the progress of elements to their final destinations, and may thus feel he has an advantage in selecting a favorable element. Even if the player guesses incorrectly, however, the player's confidence in his ability to track a symbol (or symbols) may maintain his interest in the game. Alternatively, elements in motion may be unconcealed until reaching their final destination, but may be represented as moving so quickly that it would be difficult for a player to track them before they were concealed at the final location.

According to some embodiments of the present invention, all game elements are rearranged (e.g., assigned to a position at random) for each play of the game. According to other embodiments, one or more elements remain associated with a previous selectable position.

According to various embodiments of the present invention, after an element is selected, the element may be removed from the set of elements available for selection, effectively reducing the size of the set of all possible elements. According to other embodiments, the selected element may be displayed as returning to the set of possible elements. Alternatively, a selected element may be replaced by an identical element or by a different element. For example, a replacement element may be a random symbol. In another example, the replacement element may be selected from a set of one or more "standby symbols" that may or may not be known to the player. If the standby symbols are displayed or otherwise communicated to a player, they may provide an incentive for the player to continue playing. For example, a player plays a game in which any symbols selected from a grid are replaced with symbols from a displayed queue of standby replacement symbols (e.g., a standby symbol "falls" or is "pushed" into the grid to replace a selected symbol). If a player notices that a jackpot symbol is in the queue of standby symbols, the player may be encouraged to keep playing in order to get the jackpot symbol to be incorporated in the grid.

According to some embodiments, certain game elements may be more or less favorable to the player. More favorable symbols may include, without limitation, jackpot symbols, non-"blank" symbols, symbols that always lead to a winning outcome (such as "cherry" reel symbols), symbols that may make up high-paying outcomes (e.g., the ace of spades may make up a royal flush), and so on. In some embodiments, selected elements that are more favorable may be returned to the set of all possible elements, while the unfavorable ones are removed from play. In this way, with each selection, the composition of the set of elements improves for the player by increasing the relative number of favorable elements. A player may thereby be encouraged to continue playing at a game where he knows the set of elements is improving (e.g., his odds of winning a larger payout may be improving).

Although more "favorable" elements are described above with reference to which elements may be kept in play, it will be readily apparent that any of various criteria (or combinations of criteria) may be used in determining whether a selected element is returned to the set of selectable elements, or discarded, regardless of how favorable a player believes an element to be. For example, a card game may be configured such that hearts are always returned to play regardless of rank, and other face cards are returned to play or discarded according to a predetermined distribution.

According to one or more embodiments of the present invention, an element (or combination of elements) selected by a player could alter the set of possible elements. The set of possible elements could be altered for the current play (e.g., after the first of three selections allowed during the current play) or for one or more subsequent plays. For example, the player's selection could result in one or more other symbols (or types of symbols) being added to the set of possible elements in one or more subsequent plays. For instance, a player may pick a symbol that reads: "Add the next 3 standby symbols." In another example, an added symbol may be a jackpot symbol, or other symbol that may be used in a higher paying outcome. The effect on subsequent play might be satisfying or exciting for the player, even if the selected element does not itself contribute to a winning outcome during the current play. In another example, a player-selected element (or elements) could cause one or more elements (or types of elements) to be removed from the set of possible elements for one or more subsequent plays. For instance, a player picks a symbol that reads: "Remove 2 symbols" or "Remove 2 cherry symbols." In yet another example, one or more elements selected by a player could cause any remaining elements to rearrange themselves and/or to be revealed (e.g., temporarily).

In another example, a selected element could provide a hint or suggestion about making a subsequent selection or about one or more of the remaining elements (e.g., elements not yet revealed or selected). For instance, if a player selects a "Clue" symbol, then all non-blank symbols among the symbols remaining could be highlighted. With this information the player may avoid blank symbols, but may still have the possibility of picking losing symbol combinations. Another exemplary suggestion is for half the grid to be highlighted, indicating that one or more jackpot symbols are in the highlighted half. A third exemplary hint is for one or more elements to be temporarily revealed, so that a player with a good memory might remember the locations at which the symbols reside.

As described above with respect to FIG. 10, according to some embodiments of the present invention, two or more groups of locations may be provided, with each group including all of the possible elements (e.g., with each group corresponding to a reel of a slot machine). According to other embodiments, the set of all possible elements may be distributed across two or more groups of locations. For example, all the elements of a punchboard may be associated with locations distributed graphically among three separate grids.

Regardless of whether the set of all possible elements is distributed across multiple groups or is included in each group of locations, a player provided with a plurality of groups of selectable locations may be limited to selecting a predetermined number of elements from each group, or may be free to choose up to a maximum number of elements from any one group or combination of groups. Such groups may be displayed in various configurations. For example, each group may be represented as a face of a regular or irregular polyhedron. For instance, six groups may be represented as the faces of a cube. According to some embodiments, a player may be able to rotate or otherwise re-orient the displayed polyhedron so that each of the respective groups may be viewable.

One characteristic of a conventional punchboard is that the result of prior games may effect the punchboard, which may in turn effect the current game. Accordingly, the punchboard may be described as having a "state" that was created by the prior handle pulls. According to one or more embodiments of the present invention, the set of selectable elements may be reduced from one game to another as elements are revealed by the player, without any commitment from the player to continue playing. Accordingly, if the grid carries a favorable state (e.g., no jackpot symbols have been revealed yet), the player may be encouraged to continue playing.

According to some embodiments, a player may buy a block of games in advance. For example, a player buys a block of ten games. A grid of selectable locations is then initialized for the first game, and remains in place (e.g., the respective positions of the elements are not altered) for the ten games. However, after the ten games, the grid may be initialized. One advantage of such embodiments is that they may allow for a grid with a higher expected payout. For instance, suppose a grid of outcomes has a 99% expected payout. A player is thus assured a 99% return by playing every outcome one by one. However, the player might achieve a 200% return in his first ten picks and walk away at a big profit. Therefore, the player may be able to realize a much larger expected payout from the grid by walking away at the appropriate time. As a consequence, the grid in fact has an expected payout that is higher than the 99% expected payout defined by its composite outcomes played one by one. In contrast, in embodiments in which a player pays in advance to play the grid a particular number of times, the player is financially committed to play for the purchased block of games. The grid is thus able to have a larger expected payout overall.

According to some embodiments of the present invention, the set of possible elements may be initialized according to the player's choice. For example, at the start of each game, a player might choose whether he would like to keep selecting from the grid of the last game, or whether he would like to select from an initialized grid. The player may, for example, choose a new grid when he gets a good outcome, knowing that the good outcome will no longer be available with the current grid. A player may also be given the option to have an initialized grid, for example, every five games, every twenty-five games, upon achieving a particular outcome, at after a predetermined period of time, etc.

In one or more embodiments, a set of selectable locations may remain in place until one or more game-ending symbols are chosen. For example, if a player chooses a "skeleton" symbol, then the grid is cleared, and may be initialized. For a player paying for every play, a disadvantage of choosing a game-ending symbol may be the initialization of a grid of locations that the player knew was "rich" in unrevealed favorable symbols.

According to some embodiments of the present invention, a player may have the opportunity to keep choosing elements, and/or to keep winning payouts for winning element combinations, until a game-ending element is chosen. For example, a player may pay a fixed price of ten coins and have the opportunity to keep choosing sets of three symbols. As described variously herein, the player may be paid for every set of three symbols that is a winning combination. The game finally ends when the player chooses a game-ending symbol, and the player must pay another ten coins if he wishes to continue. One advantage of such embodiments is that a player may generate a very large number of outcomes for a fixed price. According to some embodiments, if a player chooses all symbols in a grid except for the game-ending symbol, then the grid may be initialized and the player may have the opportunity to keep playing. Such a game might last indefinitely. Also, a grid need not necessarily contain a game-ending symbol. The player may then play through one or more grids without running the risk of a game-ending symbol. In some embodiments, a predetermined number of a particular type of element, or a predetermined combination of elements, may have to be selected in order to clear a board or to end a player's session. For example, a player may be allowed to keep choosing symbols for outcomes until he has chosen three game-ending symbols.

According to some embodiments, the set of possible elements may include one or more elements that eliminate or otherwise counter any revealed game-ending symbols. For instance, a "Safety" symbol may cause a previously-revealed game-ending symbol to be discarded or neutralized, or the "Safety" symbol may be "banked" and applied against a subsequently-revealed game-ending element.

In those embodiments in which a set of selectable elements (e.g., a punchboard) carries a state, players may seek out gaming devices having a good state (e.g., one recently vacated by another player) to play. Therefore, it may be desirable to initialize the set of selectable elements (e.g., clear a grid) when it is perceived that a player has left or is leaving the gaming device. Clearing a grid may comprise revealing all symbol locations, or simply making every grid location blank so it is apparent that no hidden symbols remain. The grid may also be initialized (e.g., one or more elements rearranged and/or hidden) after being cleared.

Triggering events for when a grid may be cleared may include, without limitation, when: (i) a player cashes out; (ii) there is a pause in play of a predetermined period of time; (iii) a player tracking card or other device used to identify a player (or to indicate the presence of a player) is withdrawn; and/or (iv) a credit balance reaches zero. According to some embodiments, it may be preferable to initialize a grid only when a player is known to be present at the gaming device to witness the initialization process. A player may also be warned when an action may cause the set of elements to be cleared. For instance, if the player presses a "Cashout" button, a message may flash on the screen: "Are you sure you want to cash out? This will clear the grid!"

According to some embodiments of the present invention, an outcome of a game consists of k symbols. A player may pick N symbols, where N is greater than or equal to k, and may receive outcomes consisting of all permutations of the N symbols taken k at a time. The number of such outcomes will be N!/(N−k)!. For example, if an outcome consists of three symbols, and a player is allowed to select four symbols, A, B, C, and D, then he may receive the outcomes: ABC, ABD, ACD, ACB, ADB, ADC, BAC, BAD, BCD, BCA, BDA, BDC, CAB, CAD, CBD, CBA, CDA, CDB, DAB, DAC, DBC, DBA, DCA, DCB, for a total of 4!/(4−3)!, or 24 outcomes. According to some embodiments, the player may receive a payout for some or all of the outcomes that are winning outcomes.

If the order of the symbols does not matter, then the player may still receive outcomes consisting of all permutations of his chosen symbols. Alternatively, he may receive outcomes consisting of all combinations of his N chosen symbols, taken k at a time. If the player is to receive combinations, the player would receive N!/((N−k)!k!) outcomes. For example, having chosen symbols A, B, C, and D, the player would receive four outcomes: ABC, ABD1, ACD, and BCD.

One advantage of such embodiments is that a player does not have to worry about the order in which he picks symbols. He is assured that if he picks three winning symbols, for example, then he knows he will receive a payout in accordance with at least one of the resultant outcomes. A further advantage is that when a player picks several good symbols, the player might win in two or more different ways. For example, in a slot machine-themed game, if a player picks three cherry symbols out of four picks, then six of his outcomes will be "cherry-cherry-cherry" (in a permutation embodiment). Furthermore, all the rest of his outcomes will have two cherries. Therefore, the player will typically receive a payout for each of his outcomes.

According to some embodiments, elements chosen by a player may result in only one outcome for the player, but the selected elements may be reordered from the order in which they were chosen, in accordance with one or more predetermined criteria. For example, three symbols chosen by the player may rearrange to form the highest-paying outcome of any of the possible arrangements. Similarly, when the player chooses more symbols than necessary to make an outcome, a single permutation or combination of the symbols may be selected by the gaming device according to one or more predetermined criteria, such as providing the player with the highest-paying outcome. Of course, in some embodiments a player may receive multiple permutations of his chosen symbols, where the number of permutations is less than the number of all possible permutations. For example, the player may receive the top five highest-paying outcomes out of twenty-four possible permutations.

It may be time consuming and/or frustrating for some players to have to pick three or more elements during every play (e.g., handle pull) of a game. Therefore, according to some embodiments, a single touch of a display screen may reveal multiple locations at once (e.g., the selected location as well as one or more other locations). For example, if a player touches one square on a displayed grid, then the underlying symbol for that square is revealed. In addition, the squares to the left and to the right of the selected square are revealed. Of course, touching a location may reveal the locations above and below the touched location or may reveal other locations with any predefined spatial relationship to the touched location. It will be readily apparent to those of skill in the art that other combinations of locations may be revealed, and that revealed locations need not be contiguous or proximate to one another. It will also be understood that with respect to such embodiments, a player's performance may depend on the underlying arrangement of selectable elements, as well as on the player's luck in selecting a location. For example, in a game in which grid locations to the right and left of a selected location are revealed, a player may only have a chance of winning a jackpot if three jackpot symbols are adjacent to one another; the player can only win if he then selects the middle jackpot symbol.

In some embodiments of the present invention, one or more unrevealed elements of a board may be revealed to the player after a play (e.g., a handle pull) of a game, or after a predetermined number of plays. For example, all symbols on the grid may be revealed. In this way, the player may have the opportunity to verify that it was in fact possible to achieve certain symbols, such as jackpot symbols. The player may also be encouraged, for example, by how "close" he may have been to picking a desired symbol (e.g., he may have selected a symbol that was next to a jackpot symbol).

It may be desirable to offer a large payout while still maintaining a profitable expected payout in a game in which a player may select one or more elements. Accordingly, as described variously herein, the player may be required to select a plurality of elements (e.g., three reel symbols) from the set of possible elements in order to achieve a winning combination of elements. As also described above, outcomes may be based at least in part on the order in which elements are selected from one or more groups of locations. According to some embodiments, the player may only be required to select one element, but the set of possible elements from which the player must choose is large enough to provide a profitable expected payout for the gaming device.

It may be difficult, however, to display a large number of elements at once. For example, to display all locations at once might require making the locations too small for a player to view easily, or to touch easily with his finger (e.g., without also touching an adjacent space). As described above, one or more sets of all possible elements may be displayed as distributed across two or more groups of locations. For example, after defining the set of possible elements, the gaming device (or network server) may determine two or more subsets of the possible elements and display a respective group of locations for each subset. Such groups may be displayed simultaneously, and a player may select a predetermined number of locations from each respective group, or may be able to select a predetermined number of locations in any single group of any combination of groups.

Alternatively, one group of locations may be displayed first. According to some embodiments, each subset of the set of possible elements is associated with at least one of the displayed locations. For example, the locations may be represented by images of doors, and the player selects one or more doors. When the player selects a door, the corresponding subset of elements is made available for selection (e.g., as represented by a plurality of rooms of a house) via a displayed second group of locations.

According to one or more embodiments of the present invention, a group of locations (e.g., a grid) is displayed to the player in which at least one of the locations is associated with an element of a first subset of elements, and in which at least one of the locations is associated with a second subset of elements (e.g., may trigger the display of a second group of selectable locations), as described above. Thus, a player selecting a location from a grid of locations, for example, may reveal a symbol (e.g., a cherry reel symbol) or may reveal another group of selectable locations (e.g., a second grid).

Thus, while some embodiments of the present invention provide for allowing a player to select from all possible elements of a game at one time, according to various embodiments of the present invention, there is a possibility that a player may be able to select any of the possible elements of a game, but only if he selects an appropriate location. Thus, the availability of one or more elements for selection may be dependent on one or more earlier location selections. For instance, a location within a secondary group of locations (e.g., a sub-grid) may correspond to a high-paying outcome. However, in order to receive the high paying outcome, a player must find the right location in the main grid, and then the appropriate location in the sub-grid. If each grid has 100 locations, then the player's chances of finding both correct locations are 1/100*1/100, or 1/10,000. Of course, there may be many levels of sub-grids, making for even longer odds.

A subsequent group of selectable locations (e.g., corresponding to a subset of elements) may be displayed in any of various ways. For instance, selecting a location in a first group of locations may cause the display to simulate "zooming in" on the selected location, revealing a second group of selectable locations. In other examples, the second group of locations may simply replace the first displayed group of locations, the second group of locations may appear in a different display area (e.g., while the first group remains displayed), or the first group of selectable locations may be moved to a different display area and the second group displayed in its place.

According to some embodiments of the present invention, the selection of a location does not reveal an element or outcome directly, but instead initiates a secondary random process. For example, the random process may include, without limitation, the spinning of one or more reels, the generation or selection of a random number, etc. The outcome may therefore depend on the player selection and a result of the initiated random process.

According to one or more embodiments, as described above, at least one component (e.g., a sub-element) of an outcome may be chosen from a set of possible elements by a player, and at least one other component may be selected or determined by a gaming device (or a game server). For example, a symbol (e.g., a card; a reel symbol) may be randomly generated by a slot machine using virtual and/or mechanical reels. In another example, a player may choose one of four grid locations to reveal the suit of a card he is to be dealt. Then, the gaming device may randomly select a number to determine the rank of the player's card. In yet another example, a player may first choose a sub-group of displayed locations (e.g., the left half of a grid; the locations represented by one or more particular shapes or colors). The gaming device may then select a specific location within that sub-group. One advantage of these types of embodiments is that a player may be given some feeling of control over the outcome of a game without overwhelming him with choices.

In one or more embodiments of the present invention, the display of a set of locations may comprise an image or picture. For example, a picture may be visually divided into grid locations or shapes representing puzzle pieces. The image may be a picture chosen by the casino, or a picture provided by the player (e.g., a picture of the player's pet). The image may have no particular significance to the player (or to the casino), but the player may be more likely, for any of various personal, social, or psychological reasons, to select certain locations in an image than others. For example, a player may tend to avoid some locations of an image of a face. For instance, the player may choose locations near or at the face's eyes over locations near the face's nose or ears.

It may be tiresome for some players to select elements repeatedly in a game or series of games, since selection might involve, for example, the entering of multiple coordinates on a keypad, or the touching of a small area on the screen of the gaming device. Therefore, according to some embodiments, a player may choose (or the gaming device might choose) an avatar to represent the player. Avatars may include, without limitation, an animated character. A player's avatar (e.g., in response to a signal from the player or the gaming device) may thus be represented as moving around a displayed set of locations and choosing one or more locations for the player. The player is thus saved the effort of choosing locations himself. In embodiments where one or more elements are selected by the gaming device (or game server) the avatar may serve as an entertaining way of revealing the selected elements (e.g., by approaching a location and "turning over" the element to reveal it).

According to some embodiments of the present invention, one or more preferences of locations favored by a player may be stored, for example, at a gaming device, at a casino server, or on a player tracking card. For example, a player preference may state that the player likes grid locations (3, 9), (5, 7), (10, 8). In some embodiments, at the player's request, a gaming device may automatically select locations according to one or more of a player's preferences. If there are more than a sufficient number of grid locations stored as player preferences, then the gaming device may select randomly from among the player's preferred grid locations, or may cycle through the preferences in order. If a player manually selects one or more locations, the gaming device may ask the player whether he would like to save the selected locations as preferred locations. The player may regard such locations as lucky if they revealed winning symbols. A gaming device, for example, may also use stored information about a player in making selections. For example, if the player was born in 1948, then the gaming device may choose a location identified as "48."

Various embodiments are described herein with respect to video poker. According to some embodiments, a player may choose a dealer for a game of video poker. The player may make his selection, for example, by picking a location from a grid, in which each location corresponds to a different dealer. The chosen dealer may be represented, for example, by an animated avatar that deals cards to the player. Alternatively, the selected dealer may be a live dealer (e.g., dealing at a remote location). In some embodiments, each selectable location may correspond to a deck that has been shuffled in a different way. The deck chosen by the player is then used to deal the game of video poker. In other embodiments, an entire shuffled deck of cards may be laid out face down. The player may then select a location at which the deck will be cut. According to some embodiments, a player may select from a set of locations, in which each location corresponds to a type of shuffle that will be used to shuffle a deck. For example, the player may choose a tight or loose shuffle, or a wash or riffle shuffle. The player may be able to choose exactly a desired shuffle, or may choose a grid location that reveals a type of shuffle the player was not able to predict.

It is an object of some embodiments of the present invention to provide a player of a game of chance with an illusion of control through player selection of one or more game elements.

Rather than touching the screen of a gaming device at a desired grid location, or rather than touching buttons on a keypad, according to some embodiments a player may use a biometric to select grid locations. For example, a player may place a thumb onto a print reader of a gaming device. The thumb print may be digitally overlaid on top of the grid. Then, grid locations corresponding to distinct features in the print may be automatically selected. For example, a grid location at the center of the spiral of a print may be selected. Instead of a thumb print, a picture of the player may be used.

In accordance with various embodiments of the present invention, an electronic gaming device defines a set of all possible elements of a game. For example, in a slot machine-type game, the set of possible elements includes the symbols for cherries, bell, bar, orange, plum and seven. In a card game, the set includes the fifty-two possible card values. In a punchboard-type game, the set includes various dollar amount values (various winning elements) and a "not a winner" element. The gaming device further generates a set of location assignments for each of the elements, and assigns one or more locations to each element in accordance with the set of location assignments. The player is presented with the locations and prompted to select one or more locations, depending on the type of game. The displayed locations to select are typically arranged in one or more rows of possible selections. Typically, each of the possible selections is obscured until selected by the player. The player provides his selection(s), and the corresponding selection signal(s) are received by the gaming device. Each received selection signal indicates an element from the set of possible elements which has been selected. The selected element(s) are displayed, either after each selection is made or after all selections are made. The gaming device evaluates an outcome of the game in accordance with the selected element(s). Depending on the type of game, the outcome may or may not be based on the order in which the element(s) are selected.

According to some embodiments, a player may select a location by throwing a dart at a sensor board. The sensor triggered by the dart, for example, may indicate to a gaming device one or more grid locations to select.

Alternatively, an image may be displayed that changes over time (e.g., at random; in a predetermined pattern). According to some embodiments, a player may "freeze" the image when desired. Grid locations, for example, may then be selected based on the image. For example, where an image includes two or more colors, grid locations containing one or more predetermined colors may be selected. In another example, an image contains a shifting pattern of shapes or features; grid locations covered by one or more predetermined shapes may then be selected. In another example, an avatar may move around a display of locations, and the player may stop the avatar at a particular location, for example, by pressing a button of the gaming device.

According to some embodiments, a player may use a trackball device or other pointer device or scrolling device to scroll through symbols or outcomes. By spinning the trackball, for example, the player may cause symbols to scroll by on a screen until the trackball stops spinning; the symbol (or symbols) at a predetermined position when the trackball stops spinning (e.g., at a target window) will be the player's selected symbol.

In some embodiments, an element selected by a player may indicate one or more elements that cannot be selected by a gaming device (e.g., in a secondary random process). For example, if a player picks a blank symbol from a grid, then a blank symbol will not appear as the result of a slot machine spin.

Once a location is selected by a player, the element corresponding to the location may be revealed at approximately the time the location is selected, or at some later time. A selected location may be highlighted, for example, to indicate that it has been selected by the player. For example, one or more selected symbols may remain hidden while they are displayed as traveling from the selected location to another area on a display screen (or to another display screen). Accordingly, it may be clear to the player which grid locations have been chosen before the corresponding elements have been revealed (e.g., by making the selected locations appear "empty" or blank). Of course, hidden selected elements need not "travel," but may simply appear at a final location. The player may be given an opportunity to redo one or more of his selections (e.g., before any symbols have been revealed). In addition, the final location may provide an organized format for the revealing of the symbols. For example, rather then having the revealed symbols scattered across a grid, the symbols may be moved and lined up next to each other, such as the five cards in a hand of video poker or the reels of a slot machine game.

In another example, one or more selected elements may remain hidden until some triggering event (or combination of triggering events) causes at least one of the selected elements to be revealed. For instance, a player selects several grid locations displayed at a reeled slot machine. Some of the selected grid locations are revealed immediately, and some remain hidden. Either the player or the gaming device then initiates a reel spin. Based on the result of the reel spin, one or more of the selected elements may be revealed. For example, the number of selected elements that are revealed may be based on the reel spin, or the player may have to achieve one or more predetermined outcomes in order to reveal any selected elements.

Although many of the methods described herein are described as being performed by a gaming device, it will be readily apparent to those of ordinary skill in the art that a network server may perform some or all of the described functions of the gaming device. For example, the network server may determine a set of all possible elements and/or distribute a set of elements among two or more subsets. Similarly, the gaming device may perform some or all of the described functions of the network server. For example, the gaming device may store player information (e.g., in a player database).

What is claimed is:

1. A method comprising:

determining a set of elements, the set including all possible elements of a game;

displaying a representation of each element of the set of elements;

after said displaying, associating each of the elements of the set with at least one of a plurality of locations;

after displaying the representation of each element of the set of elements, displaying a representation of the plurality of locations to a player, thereby defining a set of selectable locations;

receiving at least one selection signal, each selection signal indicating a selectable location from the set of selectable locations, the at least one selection signal thereby indicating at least one selected element; and determining an outcome based on the at least one selected element.

2. The method of claim 1, wherein said representation of the plurality of locations is displayed in an ordered state.

3. The method of claim 2, wherein said ordered state is at least one arrangement selected from the group consisting of: (i) color, (ii) type, (iii) rank, (iv) numerical rank, (v) corresponding payout, (vi) a target and (vii) a goal.

4. The method of claim 1, further comprising the step of:

presenting the player with at least one hint;

wherein said hint comprises a subset of said plurality of locations to which said at least one element is associated.

5. The method of claim 4, wherein said player pays a fee for said presenting.

6. The method of claim 4, wherein a status of the player enables said presenting.

7. The method of claim 1, further comprising the step of:

selecting at least one element before said step of receiving at least one selection signal.

8. The method of claim 1, wherein said selectable locations are different from said plurality of locations.

9. The method of claim 1, further comprising the step of:

removing at least one element from said set of elements after receiving said selection signal.

10. The method of claim 9, further comprising the step of:

replacing said at least one removed element with at least one different element.

11. The method of claim 10, wherein said at least one replaced element is indicated to the player.

12. The method of claim 1, further comprising the step of:

temporarily revealing said set of elements after receiving said selection signal.

13. The method of claim 1, further comprising the step of:

re-associating each of the elements of the set with at least one of a plurality of locations after receiving said selection signal.

14. A method comprising:

determining a set of elements, the set including all possible elements of a game;

determining a subset of the set of elements, the subset including at least one element;

associating the subset with at least one of a plurality of first locations;

displaying a representation of the at least one first location, thereby defining a first set of selectable locations;

receiving a first selection signal, the first selection signal indicating a first selectable location from the first set of selectable locations, thereby indicating the subset;

associating each at least one element of the subset with at least one of a plurality of second locations;

displaying a representation of the plurality of second locations, thereby defining a second set of selectable locations;

receiving at least one second selection signal, each at least one second selection signal indicating a second selectable location from the second set of selectable locations;

determining at least one selected element based on the at least one second selection signal; and determining an outcome based on the at least one selected element.

15. A method comprising:

determining a set of elements, the set including all possible elements of a game;

determining a first subset of the set of elements, the first subset including at least one first element;

associating each at least one first element of the first subset with at least one of a plurality of first locations;

displaying a representation of the plurality of first locations, thereby defining a first set of selectable locations;

determining a second subset of the set of elements, the second subset including at least one second element;

associating the second subset with at least one second location;

displaying a representation of the at least one second location, thereby defining a second set of selectable locations;

receiving a first selection signal, the first selection signal indicating a first selectable location from the first set of selectable locations, thereby indicating a first selected element;

receiving a second selection signal, the second selection signal indicating a second selectable location from the second set of selectable locations, thereby indicating the second subset;

associating each at least one second element of the second subset with at least one of a plurality of third locations;

displaying a representation of the plurality of third locations, thereby defining a third set of selectable locations;

receiving a third selection signal, the third selection signal indicating a third selectable location from the third set of selectable locations, thereby indicating a second selected element; and determining an outcome based on the first selected element and the second selected element.

16. A method comprising:

determining a set of elements, the set including all possible elements of a game;

determining a first subset of the set of elements, the first subset including at least one first element;

associating each element of the first subset with at least one of a plurality of first locations;

displaying a representation of the plurality of first locations, thereby defining a first set of selectable locations;

receiving at least one first selection signal, each first selection signal indicating a selectable location from the first set of selectable locations, the at least one first selection signal thereby indicating at least one first selected element;

determining a second subset of the set of elements, the second subset including at least one second element;

associating each element of the second subset with at least one of a plurality of second locations;

displaying a representation of the plurality of second locations, thereby defining a second set of selectable locations;

receiving at least one second selection signal, each second selection signal indicating a selectable location from the second set of selectable locations, the at least one second selection signal thereby indicating at least one second selected element; and determining an outcome based on the at least one first selected element and the at least one second selected element.

17. A method comprising:

determining a set of elements, the set including all possible elements of a game;

associating each of the elements of the set with at least one of a plurality of locations;

displaying a representation of the plurality of locations to the player, thereby defining a set of selectable locations;

displaying a representation of at least one element of the set;

receiving at least one selection signal, each selection signal indicating a selectable location from the set of selectable locations;

determining at least one selected element based on the at least one selection signal; and determining an outcome based on the at least one selected element; wherein displaying the representation of the at least one element of the set comprises displaying a representation of the at least one element of the set in motion from a first display area to a second display area.

18. A method comprising:

determining a set of elements, the set including all possible elements of a game;

associating each of the elements of the set with at least one of a plurality of locations;

displaying a representation of the plurality of locations to the player, thereby defining a set of selectable locations;

displaying a representation of at least one element of the set;

receiving at least one selection signal, each selection signal indicating a selectable location from the set of selectable locations;

determining at least one selected element based on the at least one selection signal; and determining an outcome based on the at least one selected element; wherein displaying the representation of the at least one element of the set comprises:

displaying a first representation of the at least one element of the set at a location that is not selectable; and displaying a second representation of the at least one element of the set in motion.

19. The method of claim 18, in which the second representation of the at least one element represents the at least one element as concealed while in motion.

20. A method comprising:

determining a set of elements, the set including all possible elements of a game;

associating each of the elements of the set with at least one of a plurality of locations;

displaying a representation of the plurality of locations to the player, thereby defining a set of selectable locations;

displaying a representation of at least one element of the set;

receiving at least one selection signal, each selection signal indicating a selectable location from the set of selectable locations;

determining at least one selected element based on the at least one selection signal; and determining an outcome based on the at least one selected element; wherein displaying the representation of the at least one element of the set comprises displaying the at least one element in an ordered arrangement.

* * * * *